US009872374B2

(12) United States Patent
Poole et al.

(10) Patent No.: US 9,872,374 B2
(45) Date of Patent: Jan. 16, 2018

(54) LIQUID THIN-FILM LASER TARGET

(71) Applicant: OHIO STATE INNOVATION FOUNDATION, Columbus, OH (US)

(72) Inventors: Patrick Poole, Columbus, OH (US); Claude David Andereck, Dublin, OH (US); Douglass Schumacher, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 15/313,315

(22) PCT Filed: May 22, 2015

(86) PCT No.: PCT/US2015/032268

§ 371 (c)(1),
(2) Date: Nov. 22, 2016

(87) PCT Pub. No.: WO2015/179819

PCT Pub. Date: Nov. 26, 2015

(65) Prior Publication Data

US 2017/0196074 A1 Jul. 6, 2017

Related U.S. Application Data

(60) Provisional application No. 62/001,698, filed on May 22, 2014, provisional application No. 62/082,911, filed on Nov. 21, 2014.

(51) Int. Cl.

| | |
|---|---|
| ***H05H 6/00*** | (2006.01) |
| ***H05H 15/00*** | (2006.01) |
| ***H01J 27/24*** | (2006.01) |
| ***G21G 4/02*** | (2006.01) |

(52) U.S. Cl.
CPC ..... *H05H 6/00* (2013.01); *G21G 4/02* (2013.01); *H01J 27/24* (2013.01); *H05H 15/00* (2013.01)

(58) Field of Classification Search
CPC .. H05H 6/00; H05H 15/00; G21G 4/02; H01J 27/24
USPC ..... 250/493.1, 504 R; 313/150, 163, 165, 313/170, 171, 172
See application file for complete search history.

(56) References Cited

U.S. PATENT DOCUMENTS

| | | | | |
|---|---|---|---|---|
| 6,002,744 | A | 12/1999 | Hertz et al. | |
| 7,518,134 | B2 * | 4/2009 | Ivanov | H05G 2/003 250/492.1 |
| 7,622,727 | B2 * | 11/2009 | Shirai | B82Y 10/00 250/423 R |
| 7,759,663 | B1 * | 7/2010 | Van Herpen | B82Y 10/00 250/492.1 |

(Continued)

OTHER PUBLICATIONS

Davis, J., & Petrov, G. M. (2011). Neutron production from ultra-short pulse lasers using linear and circular polarization. Physics of Plasmas (1994-present), 18(7), 073109.

(Continued)

*Primary Examiner* — Michael Maskell
(74) *Attorney, Agent, or Firm* — Meunier Carlin & Curfman LLC

(57) ABSTRACT

Described in this disclosure is a laser target comprised of a liquid film creation device that is configured to form a liquid laser target. Methods of forming a liquid thin-film laser target are also described.

21 Claims, 16 Drawing Sheets

(56) References Cited

U.S. PATENT DOCUMENTS

| | | | | |
|---|---|---|---|---|
| 8,368,867 | B2 * | 2/2013 | Kim | G02F 1/1341 349/154 |
| 2007/0085044 | A1 * | 4/2007 | Hergenhan | H05G 2/003 250/504 R |
| 2007/0160846 | A1 * | 7/2007 | Koinuma | C09K 19/38 428/411.1 |
| 2008/0180029 | A1 * | 7/2008 | Hergenhan | H05G 2/005 315/111.21 |
| 2009/0230318 | A1 | 9/2009 | Fourkal et al. | |
| 2012/0280138 | A1 | 11/2012 | Choi et al. | |
| 2013/0161530 | A1 * | 6/2013 | Hayashi | H01J 27/24 250/423 P |
| 2013/0228699 | A1 * | 9/2013 | Kakutani | H01J 27/024 250/423 P |
| 2014/0375974 | A1 * | 12/2014 | Yakunin | G03F 7/70033 355/67 |
| 2015/0123009 | A1 * | 5/2015 | Shin | H01J 27/24 250/424 |

OTHER PUBLICATIONS

International Search Report and Written Opinion of the International Searching Authority, Application No. PCT/US2015/032268, dated Aug. 21, 2015, 9 pages.

Karsch, S. et al. (2003). High-intensity laser induced ion acceleration from heavy-water droplets. Physical review letters, 91(1), 015001.

Martin, B. K., Wu, X. L., Goldburg, W. I., & Rutgers, M. A. (1998). Spectra of decaying turbulence in a soap film. Physical review letters, 80(18), 3964.

Morrison, J. T. et al. (2012). Selective deuteron production using target normal sheath acceleration. Physics of Plasmas (1994-present), 19(3), 030707.

Nayuki, T. et al. (2003). Thin tape target driver for laser ion accelerator. Review of scientific instruments, 74(7), 3293-3296.

Nishiuchi, M. et al. (2008). Efficient production of a collimated MeV proton beam from a polyimide target driven by an intense femtosecond laser pulse. Physics of Plasmas (1994-present), 15(5), 053104.

Ogura, K. et al. (2012). Proton acceleration to 40 MeV using a high intensity, high contrast optical parametric chirped-pulse amplification/Ti: sapphire hybrid laser system. Optics letters, 37(14), 2868-2870.

Passoni, M., Bertagna, L., & Zani, A. (2010). Target normal sheath acceleration: theory, comparison with experiments and future perspectives. New Journal of Physics, 12(4), 045012.

Pirozhkov, A. S. et al. (May 2009). Laser-driven proton acceleration and plasma diagnostics with J-KAREN laser. In SPIE Europe Optics+ Optoelectronics (pp. 735414-735414). International Society for Optics and Photonics.

Poole, P. L. et al. (2014). Liquid crystal films as on-demand, variable thickness (50-5000 nm) targets for intense lasers. Physics of Plasmas (1994-present), 21(6), p. 1-5.

Poole, P. L., Willis, C., Cochran, G. E., Hanna, R. J., Andereck, C. D., & Schumacher, D. W. (2015). In-situ, variable thickness, liquid crystal film target formation at moderate repetition rate for intense laser applications. arXiv preprint arXiv:1507.08259. p. 1-7.

Rutgers, M. A., Wu, X. L., & Daniel, W. B. (2001). Conducting fluid dynamics experiments with vertically falling soap films. Review of Scientific Instruments, 72(7), 3025-3037.

Winkler, M., Kofod, G., Krastev, R., Stöckle, S., & Abel, M. (2013). Exponentially fast thinning of nanoscale films by turbulent mixing. Physical review letters, 110(9), 094501.

International Preliminary Report on Patentability issued by the International Bureau of WIPO dated Nov. 22, 2016, in Application No. PCT/US2015/032268, 6 pages.

* cited by examiner

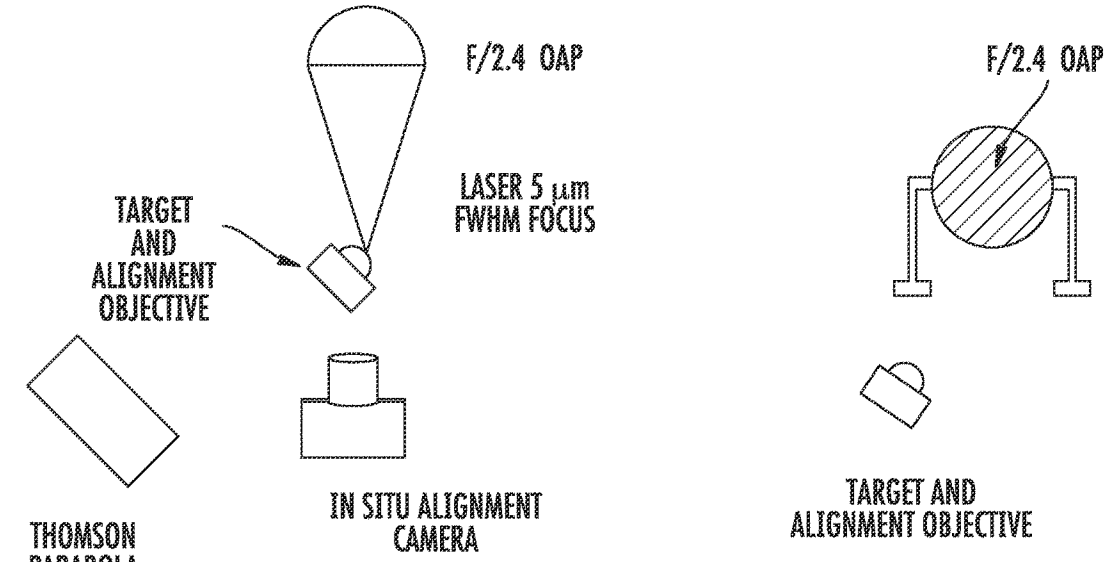
FIG. 13A
FIG. 13B
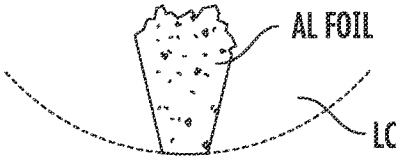
FIG. 13C

LIQUID THIN-FILM LASER TARGET

CROSS REFERENCE TO RELATED APPLICATIONS

This application claims priority to and benefit of U.S. Provisional Patent Application Ser. No. 62/001,698 filed on May 22, 2014 and U.S. Provisional Patent Application Ser. No. 62/082,911 filed on Nov. 21, 2014, both of which are fully incorporated by reference and made a part hereof.

GOVERNMENT SUPPORT CLAUSE

This invention was made with government support under Contract No. GRT00030083 awarded by Defense Advanced Research Projects agency (DARPA). The government has certain rights in this invention.

TECHNICAL FIELD

The present disclosure is in the field of liquid film-based laser targets.

BACKGROUND

Lasers with high intensities have enabled a wide range of applications, including ion acceleration and its use in neutron radiography, ion cancer therapy, and nuclear physics, as well as energetic electron acceleration to generate both x-rays for advanced imaging and positron beams for laboratory astrophysics.

The development of laser technology with peak intensities in excess of, for example, approximately $10^{21}$ W/cm$^2$ has led to the need for advanced targets for use in experiments with such lasers. Targets with planar geometries can be optimized for differing acceleration mechanisms by varying their thickness. Target Normal Sheath Acceleration (TNSA) is the dominant ion acceleration process for targets that are a few micrometers thick. Sub-micron thick targets enable the Radiation Pressure Acceleration (RPA) and Break-Out Afterburner (BOA) regimes, each of which has characteristic ion signals that are useful for different applications. However, the target thickness range where these acceleration mechanisms turn on or dominate can vary depending on laser energy and intensity; therefore, a target with finely-tunable thickness is desired for ion acceleration optimization.

Available methods of ion acceleration operate at an approximately one shot per hour, low repetition rate. Additionally, they cycle a chamber or cryogenic system for each shot or for a few shots. Moreover, they employ single-shot or few shot delivery mechanisms. They furthermore require careful alignment of each target using multiple cameras or alignment beams in a time-intensive process.

Laser facilities are now available that can operate at high repetition rates (e.g., 10 Hz and greater). However, the ability to provide targets with such time scales is undeveloped, blunting the utility of these laser upgrades. Two known methods to generate high repetition rate targets for intense lasers use tape targets and gas or liquid targets.

Tape targets typically comprise solid-state films as thin as two microns. Polyimide tape targets have been used with thicknesses exceeding five microns at low repetition-rates. Such targets are commonly implemented as spooled tapes with motors that pull the thin foil through the laser focus.

These setups suffer from low operational lifetimes due to tape fragility, in addition to longitudinal jitter in the direction of laser propagation.

Another method to generate high repetition rate targets for intense lasers uses gas or liquid jet targets. However, these targets have inferior laser interactions compared to planar solid targets since they produce fewer and lower energy accelerated particles. Additionally, the densities usually desired for these gas or liquid jets are such that the "missed" shot rate is high due to no particles being within the laser focal region. Compared to a planar target, gas or liquid jet targets suffer from inferior laser interaction due to their dispersed nature or cylindrical geometry. Finally, this method produces targets that are several microns thick or more and thus are unable to take advantage of mechanisms that require sub-micron targets.

Liquid jet streams serving as the target within a chamber have been employed for lithography applications. In such applications, differential vacuum pumping between the vacuum chamber section that houses the liquid jet and the rest of the chamber is employed. As a result only the pressure within the outer section is at low levels, while the section that directly houses the liquid jet is closer to atmospheric pressure. For the many applications that rely on an intense laser pulse (especially with short pulse durations on the order of picoseconds or less) this higher pressure region is critically detrimental to the laser, rendering this target system unusable on such laser systems.

Furthermore, the laser pulse has a structure in time and space that depends in detail on the design of the laser. Typically, one or more relatively weak pulses precede the main, more powerful pulse. The main pulse itself may have a non-ideal rising edge that turns on too slowly. The undesirable structure before the main pulse is referred to as pre-pulse. Pre-pulse may have a deleterious effect on the main pulse's interaction with a target. For example, the pre-pulse can easily be powerful enough to generate blow-off plasma from the surface of the target. This greatly limits the effectiveness of the main pulse. In the case of some lasers and targets, the pre-pulse may even destroy the target before the main pulse arrives, impeding the experiment or application.

A few methods have been developed that help to reduce the pre-pulse. This serves to improve the "contrast" of the laser. The contrast is the ratio of the main pulse intensity to the pre-pulse intensity. One exemplary method uses plasma mirrors. These devices operate by only allowing the most intense part of the laser pulse to reflect from them and progress to the target. Unwanted pre-pulse transmits through the mirror and never reaches the target.

Plasma mirrors are difficult to operate owing to the precise laser spot size required for their operation. Once a laser system is aligned, the laser spot size at the location of the plasma mirror is not an easily adjustable parameter. Moreover, the same location on a plasma mirror cannot be used more than once. This requires the mirrors to be constantly moved or rotated so that the laser interacts with a new location each time. Consequently, plasma mirror operation is limited to low repetition rates. While, plasma mirrors grant a couple orders of magnitude contrast improvement, they do so at the cost of approximately half of the laser pulse energy. Additionally they introduce distortions in the spatial mode that limit laser focusing. After a small number of laser shots, they must be replaced costing both funds and time.

Therefore, systems, methods and apparatuses are desired that overcome challenges in the art, some of which are described above.

SUMMARY

Liquid Crystal (LC) films can serve as a laser target. Combining the physical properties of both liquids and solids, LCs are long-chain molecules consisting chiefly of hydrocarbons. The crystal-like properties arise from phase-dependent orientational (referring to whether molecules are mostly pointing in the same direction) and positional order (referring to whether molecules are arranged in any sort of ordered lattice) of these molecules. Moreover, order can be either short-range (only between molecules close to each other) or long-range (extending to larger, sometimes macroscopic, dimensions). In general, LCs undergo a phase transition as they shift between different ordered states; as a result LCs are often characterized by what types of order they can take on and under what conditions they undergo phase transitions between those states. Two common LC phases are the nematic phase where the molecules have strong orientational order but no positional order, and smectic where the molecules exhibit both orientational and positional order. The smectic phase is optimum for making thin films, as it is comprised of stacks of thin directionally-oriented layers.

The liquid film target described in this disclosure has all the physics advantages of a solid planar target in terms of accelerated particle count and energy, and has none of the detriments arising from a spinning solid tape foil. The apparatus detailed in this disclosure also provides real-time target thickness control. Additionally, the targets can be used for a wide array of other applications that involve higher intensity lasers, due to the low vapor pressure of LCs. Aspects of the disclosure are not susceptible to shock waves and debris generated from one laser hit propagating upstream and affecting targets for the next shot; instead a fresh target is made before each laser shot.

Additionally, the LC films can be used to clean intense laser pulses by removing pre-pulse and sharpening the leading edge of the main pulse. Real-time LC film thickness tuning allows for controlling the degree of pulse cleaning. The LC films can absorb or reflect the pre-pulse, while allowing the main pulse to transmit through with little modification. In one embodiment LC film is destroyed by each pre-pulse, but another LC film is generated before the next pulse arrives, leading to high repetition rates. Additionally, the thickness variability of the liquid crystals allows much easier adjustment than a plasma mirror to accommodate varying laser parameters.

In one aspect of the disclosure, a laser target can comprise a liquid film creation device configured to form a liquid laser target. Furthermore, the liquid film creation device can have a disk with one or more holes passing axially through it, and the disk can spin about its axis forming the liquid laser target in at least one of the one or more holes. Moreover, the holes can be circular, rectangular, square, for example, or any other shape. The holes can, furthermore, be equidistant or non-equidistant from the center axis of the disk. Moreover, the liquid film creation device can have a reservoir containing a liquid that forms the liquid laser target. In one aspect, a portion of the disk rotates through the liquid in the reservoir causing the liquid laser target to form in at least one of the one or more holes. The liquid film creation device can have a pump that deposits a volume of a liquid that forms the liquid laser target near or in at least one of the holes that pass axially through the disk. The volume of liquid deposited can be approximately 100 nL to approximately 1000 nL. In another aspect, the liquid that forms the liquid laser target can be pumped to a center of the disk and then travels outward towards a circumference of the disk until it encounters and fills at least one of the one or more holes. The pump can be fluidly connected with a reservoir that contains a liquid that forms the liquid laser target. The pump can be a precision syringe pump.

The liquid film creation device can furthermore have a wiper that removes excess liquid from the disk and helps form the liquid laser target in at least one of the one or more holes. The liquid film creation device can have an additional linear stage for fine position adjustment with, for example, a picomotor piezo linear actuator, to change the relative position of the wiper and the disk on a small scale. The liquid film creation device can further have a heater to control the temperature of the disk or the liquid that forms the liquid laser target. The laser target heater can be, for example, a cartridge heater or induction heater. A PID controller and a thermocouple can be used to control the heater and maintain the temperature of the disk or the liquid that forms the liquid laser target. Optical pyrometry can be used to measure temperature of the disk or the liquid that forms the liquid laser target. Moreover, an edge frame connected with at least one of the one or more holes of the disk can be used to control thickness and location of formation of the liquid laser target. In one aspect, the edge frame can have a thickness of approximately 10 microns. The edge frame can be at least partially comprised of diamond.

The liquid laser target can have a thickness of between approximately 10 and over 5000 nm. The thickness of the liquid laser target depends at least in part on one or more of wiper angle, wiper draw speed, wiper material and finish, temperature of the disk, temperature of a liquid that includes the liquid laser target, disk rotation speed and size of the one or more holes. Each of the one or more holes passing axially through the disk can have a size of between approximately 100 microns and 5 millimeters. The laser target can be presented to a laser for firing at a repetition rate of at least approximately 2 Hz or greater including, for example, approximately 10 Hz or greater. Furthermore, the liquid laser target can be a liquid crystal material. In one aspect, the liquid crystal material can be 8CB (4'-octyl-4-cyanobiphenyl). In other aspects, the liquid crystal material can be thermotropic liquid crystals or lyotropic liquid crystals.

In another aspect of the disclosure, the liquid film creation device can have a linear rail that can have one or more holes passing through a portion of the rail. The liquid laser target can be formed in at least one of the one or more holes. Moreover, the holes can be circular, rectangular, square, for example, or any other shape. The holes can, furthermore, be arranged in any pattern on the rail. The liquid film creation device can have a reservoir that contains a liquid that forms the liquid laser target. A pump can deposit a volume of a liquid that forms the liquid laser target near or in at least one of the holes that pass through the portion of the rail. The volume of liquid deposited near or in at least one of the holes can be approximately 100 nL to approximately 1000 nL. The pump can be fluidly connected with a reservoir that contains a liquid that forms the liquid laser target. The pump can be a precision syringe pump.

The linear rail liquid film creation device can have a wiper, that removes excess liquid from the disk and helps form the liquid laser target in at least one of the one or more holes. The linear rail liquid film creation device can have an additional linear stage for fine position adjustment with, for example, a picomotor piezo linear actuator, to change the relative position of the wiper and the rail on a small (e.g. approximately tens of nanometer) scale. A heater can control the temperature of the rail and wiper or the liquid that forms the liquid laser target. The heater can be, for example, a cartridge heater or an induction heater. A PID controller and a thermocouple can be used to control the heater and maintain the temperature of the rail or the liquid that forms the liquid laser target. Optical pyrometry can be used to measure temperature of the rail and wiper or the liquid that forms the liquid laser target. An edge frame connected with at least one of the one or more holes of the rail can be used to help control the thickness and location of formation of the liquid laser target. The edge frame can have a thickness of approximately 10 microns. The edge frame can be at least partially comprised of diamond. The liquid laser target can have a thickness of between approximately 10 and 5000 nm. The thickness of the liquid laser target depends at least in part on one or more of wiper angle, wiper draw speed, wiper material and finish, temperature of the rail, temperature of a liquid that comprises the liquid laser target, and size of the one or more holes. Each of the one or more holes passing through a portion of the rail has a size of between approximately 100 microns and 5 millimeters. A liquid laser target can be presented to a laser for firing at a repetition rate of at least approximately 1 Hz or greater. The liquid laser target can be a liquid crystal material. The liquid crystal material can be 8CB (4'-octyl-4-cyanobiphenyl). Moreover, the liquid crystal material can be thermotropic liquid crystals or lyotropic liquid crystals.

In another aspect of the disclosure, the liquid film creation device can be a block of material on a substrate having a nozzle. The liquid laser target can be formed near the nozzle forcing a liquid through it to form at least one stable thin sheet of the liquid. The block can be, for example, PDMS or sapphire and the substrate can be formed of, for example, silica or sapphire. The block can have metal inserts. The nozzle can be, for example, a rectangular nozzle. A laser can be aimed directly below the nozzle such that it interacts with the stable thin sheet of liquid. The liquid film creation device can have a heater to control the temperature of one or more of the block, substrate or a liquid that forms the liquid laser target. The heater can be, for example, a cartridge heater or an induction heater. A PID controller and a thermocouple can be used to control the heater and maintain the temperature of the block, substrate, or the liquid that forms the liquid laser target. Optical pyrometry can be used to measure temperature of the block, substrate or the liquid that forms the liquid laser target. The liquid laser target can have a thickness of between approximately 500 nm and 10000 nm. The liquid laser target can be a liquid crystal material. The liquid crystal material can be 8CB (4'-octyl-4-cyanobiphenyl). Moreover, the liquid crystal material can be thermotropic liquid crystals or lyotropic liquid crystals.

In another aspect of the disclosure, a method of forming a laser target comprising providing a bulk liquid crystal material; and using a liquid film creation device, forming a thin-film liquid crystal laser target is disclosed. Forming the thin-film liquid crystal laser target can be performed using, for example, a disk that can have one or more holes passing axially through the disk. The disk can spin about its axis forming the thin-film liquid crystal laser target in at least one of the one or more holes. Forming the thin-film liquid crystal laser target can alternatively be performed using a linear rail having one or more holes passing through a portion of the rail. Furthermore, the thin-film liquid crystal laser target is formed in at least one of the one or more holes. Forming the thin-film liquid crystal can furthermore and alternatively be performed using a block of material on a substrate having a nozzle. The thin-film liquid crystal laser target can be formed near the nozzle by forcing the bulk liquid crystal through it to form at least one stable thin sheet of the liquid. The bulk liquid crystal material can be 8CB (4'-octyl-4-cyanobiphenyl). The bulk liquid crystal material can moreover be thermotropic liquid crystals or lyotropic liquid crystals.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems:

FIG. 13*a* presents a schematic of an experimental target chamber.

FIG. 13*b* illustrates the actual experimental set-up with off-axis parabola (OAP) in the background and the target frame and alignment objective in the foreground.

FIG. 13*c* illustrates a 3 micrometer aluminum film alignment fiducial within a liquid crystal film.

DETAILED DESCRIPTION

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

Figure 1:
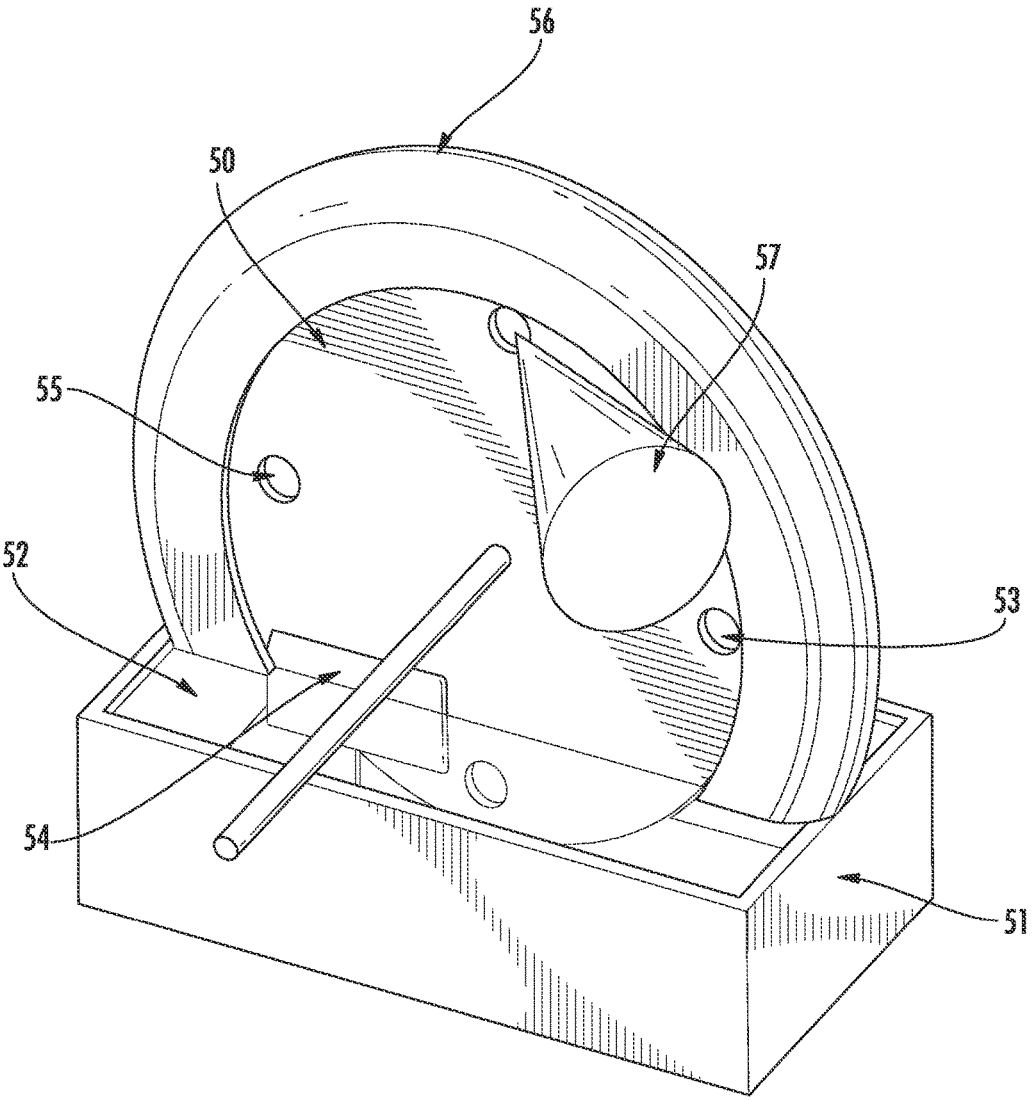
FIG. 1 shows one aspect of a liquid film creation device constructed from a vertically oriented metal disk confined to spin about its center axis.

FIG. 1 shows one embodiment of a device for creating a thin-film liquid laser target comprising a vertically oriented metal disk 50 configured to spin about its center axis. A motor or other drive mechanism (not shown) causes the metal disk 50 to rotate about the center axis of the disk 50. In one embodiment, the lower portion of the disk is immersed in a reservoir of liquid solution 51 comprising a film target material 52. For example, the film target material 52 can be a bulk liquid crystal (LC) material. The disk 50 has one or more small diameter circular holes (e.g., a diameter of approximately 100 microns to a few millimeters) 53 that pass through the disk 50 in an axial direction. However, the holes do not have to be circular. They can be square, rectangular, for example, or any other shape. The holes can, furthermore, be equidistant or non-equidistant from the center axis of the disk. A thin-film liquid laser target forms in at least one of the one or more holes 53 as the disk 50 rotates to immerse the holes 53 in the reservoir 51. The one or more holes 53 also have a thickness that is dependent upon the thickness of the disk 50 at the location of the holes 53. As shown in FIG. 1, the disk 50 rotates in a clockwise fashion such that the holes 53 rising from the liquid solution 52 contact a wiper blade 54 held just above the reservoir liquid's surface. The wiper blade 54 removes excess solution except for that contained within the small holes 53, leaving a film 55 whose thickness depends on the disk rotation speed, wiper angle with respect to the disk, thickness of the small holes, properties of the liquid, and temperature control of the disk and/or the liquid. It is to be appreciated that the disk can also rotate in a counter-clockwise direction with appropriate placement of the wiper blade 54.

The disk 50 continues to rotate, moving the film-filled hole 55 to a position where a laser 57 shoots the target film (i.e., the film filling the hole) 55. In one aspect, the laser shot destroys the film 55 before the rotation of the disk re-immerses the now empty hole 53 back into the reservoir 51 to re-form the target films 55. In another aspect, the target film 55 absorbs low energy level pulses that may precede the main laser pulse that destroys the target film, thereby "cleaning" the laser shot. By varying the rate at which the disk 50 is rotated, the frequency at which the laser 57 is presented with a target film 55 can be controlled. This can lead to high repetition rates, for example, accommodating laser firing rates of at least approximately 10 Hz. This apparatus may include an optional hood 56 surrounding the spinning disk 50 to catch excess liquid for collection in the main reservoir 51 or an auxiliary storage reservoir (not shown).

Figure 2:
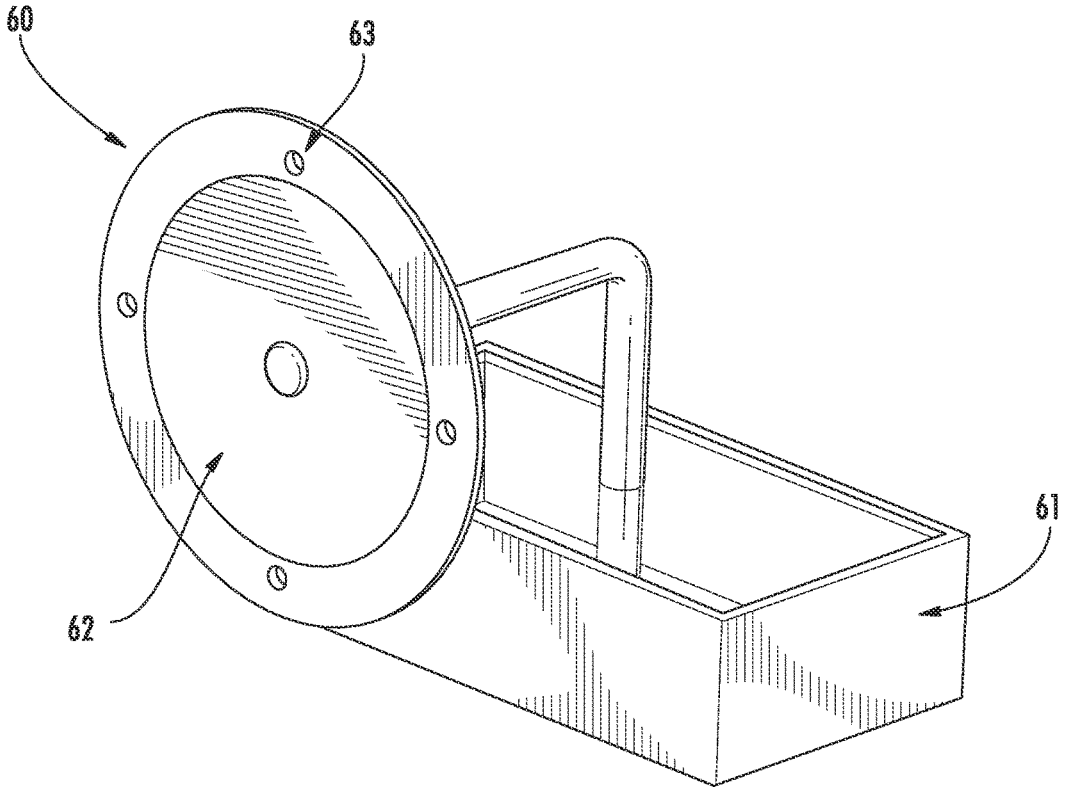
FIG. 2 shows another aspect of a liquid film creation device wherein the vertically oriented metal disk is again configured to spin about its center axis. The disk is in fluid communication with a reservoir of liquid solution comprising the film target material such that the film target material can be spin-coated across at least one side of the metal disk.

FIG. 2 shows another embodiment of a device for creating a thin-film liquid laser target wherein the vertically oriented metal disk 60 is again configured to spin about its center axis. A motor or other drive mechanism (not shown) causes the metal disk 60 to rotate about the center axis of the disk 60. The disk is in fluid communication with a reservoir of liquid solution 61 comprising the film target material such that the film target material can be spin-coated 62 across at least one side of the metal disk. For example, the film target material can be pumped from the reservoir 61 to the center of the disk and then centrifugal force causes the film target material to migrate radially outward until a film forms in at least one of the one or more holes 63 of the disk. The volume of the LC delivered can be controlled by metering the LC delivered to the disk 60 using, for example, a precision syringe pump (not shown). As the film target material travels outward towards the circumference of the spinning metal disk it encounters, and fills, at least one of the one or more small diameter circular holes (e.g., diameters of 100 microns to a few millimeters) 63. This apparatus may include a hood, not shown, surrounding the spinning disk 60 to catch excess liquid for collection in the reservoir 61 or an auxiliary storage reservoir (not shown). Again, the laser is aimed such that it can hit the small holes filled with target films. Centrifugal force continues to cause the film target materiel to form a new film in the small holes by the time the laser is ready to fire again. Again, this can lead to high repetition rates, for example, accommodating laser firing rates of at least approximately 10 Hz. In this embodiment, film thickness depends on the disk rotation speed, thickness of the small holes, properties of the liquid, and temperature control of the disk and/or the liquid.

Figure 3A:
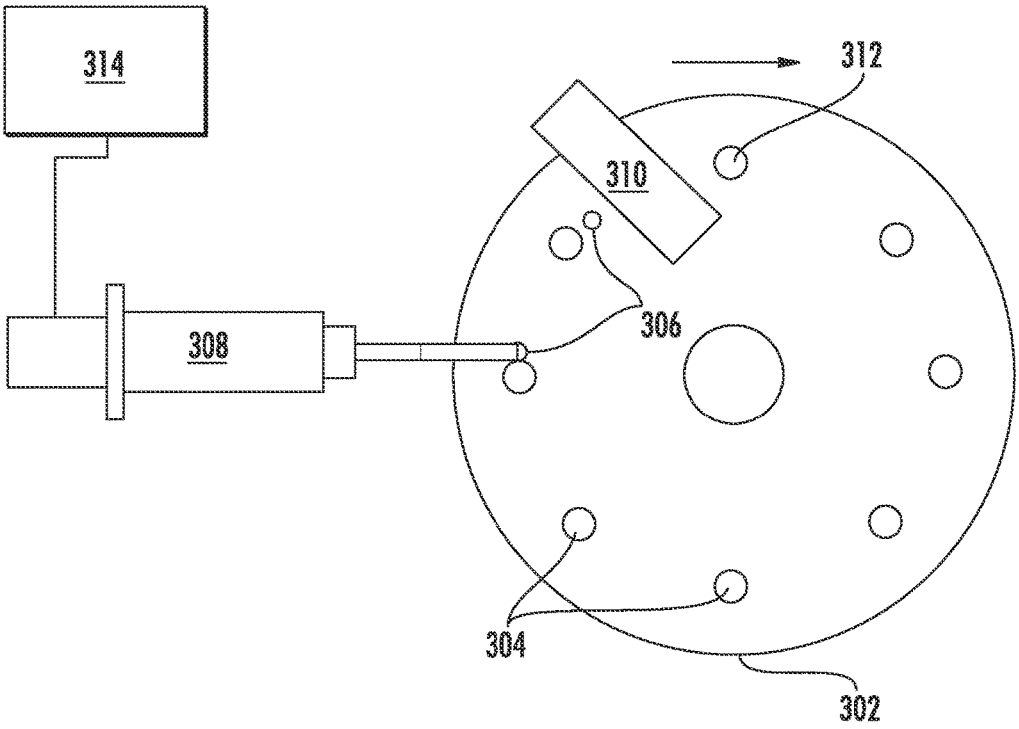
FIG. 3*a* illustrates an alternate embodiment of a device for creating a thin-film liquid laser target with a disk.

FIG. 3*a* illustrates an alternate embodiment of a device for creating a thin-film liquid laser target. In this embodiment, a disk 302 comprising one or more holes 304 is spinning about its axis. As shown, the disk 302 is spinning in a clockwise direction, though it is contemplated that the disk may also be configured to spin in a counter-clockwise direction. As the disk 302 spins, a precision measured drop 306 of liquid target material is placed on the disk 302 near one of the one or more holes 304 or within the hole 304. In this embodiment, the drop 306 is placed using a precision pump 308 such as, for example, a syringe pump. The syringe pump can comprise, for example, a Harvard Apparatus PHD syringe pump (Harvard Apparatus, Holliston Mass. USA). As the disk 302 continues to spin, the drop 306 encounters a wiper 310 that spreads the drop 306 across the hole 302, creating a thin film laser target 312 in the hole 302. The device can have an additional linear stage (not shown) for fine position adjustment with, for example, a picomotor piezo linear actuator, to change the relative position of the wiper and the disk on a small scale. As shown in FIG. 3*a*, the pump 308 can be controlled by a control device 314. The control device 314 can be, for example, a microprocessor, a programmable logic controller (PLC), a field-programmable gate array (FPGA), a laptop computer, and the like. Again, the configuration of the device shown in FIG. 3*a* can lead to high repetition rates, for example, accommodating laser firing rates of at least approximately 10 Hz. The thickness of the film 312 in the one or more holes 304 can be controlled by the disk rotation speed, wiper angle with respect to the disk, thickness of the small holes, volume of the drop of liquid target material, properties of the liquid and temperature control of the disk and/or the liquid.

Figure 3B:
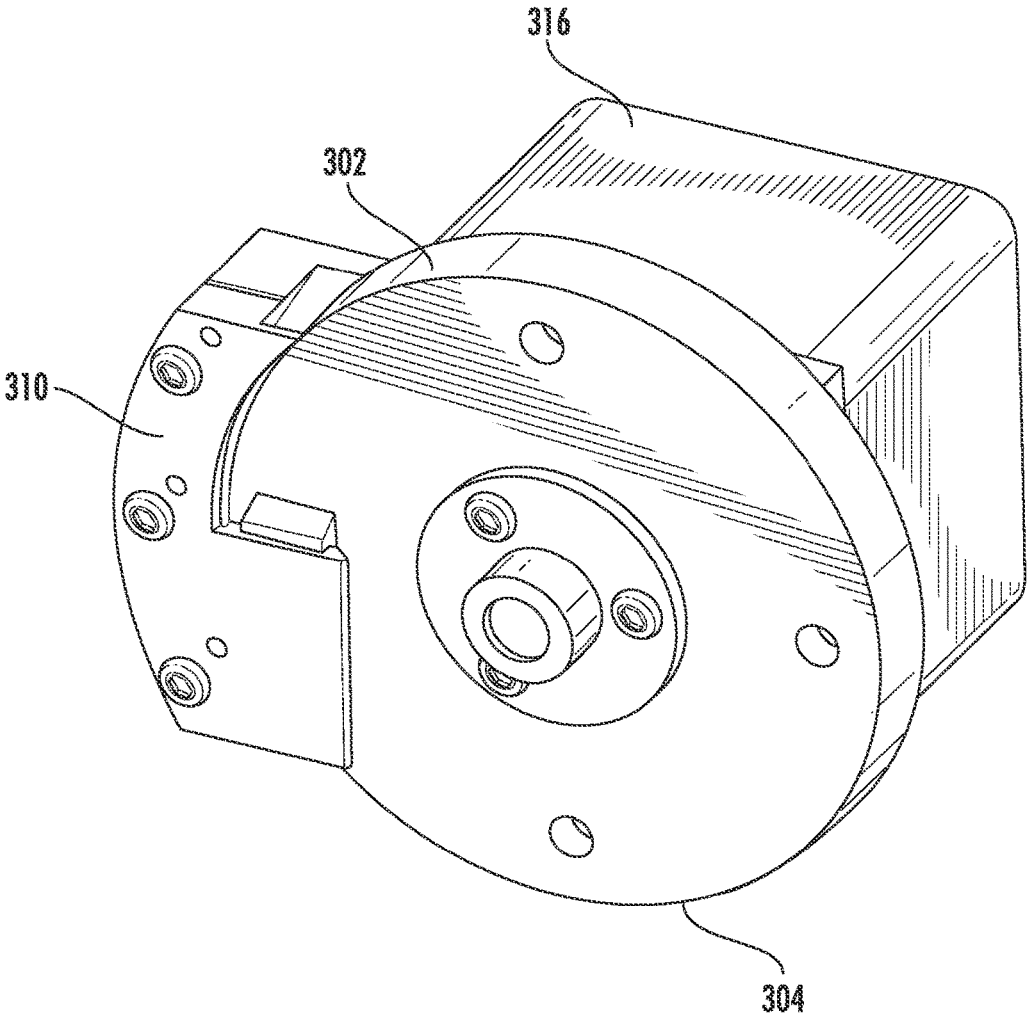
FIG. 3*b* is a rendering of an embodiment of a device for creating a thin-film liquid laser target with a disk.

FIG. 3*b* is a rendering of an embodiment of a device for creating a thin-film liquid laser target. Though FIG. 3*b* does not show the pump 308 described in relation to FIG. 3*a*, nor does it show the linear stage for fine position adjustment, the disk 302, one or more holes 304, and wiper 310 are shown. Further, the drive mechanism 316 is shown in FIG. 3*b*. In this embodiment, the drive mechanism 316 is an electric motor. The mass of the device for creating a thin-film liquid laser target is useful for stability and accuracy when aligning the laser with the target.

Figure 4A:
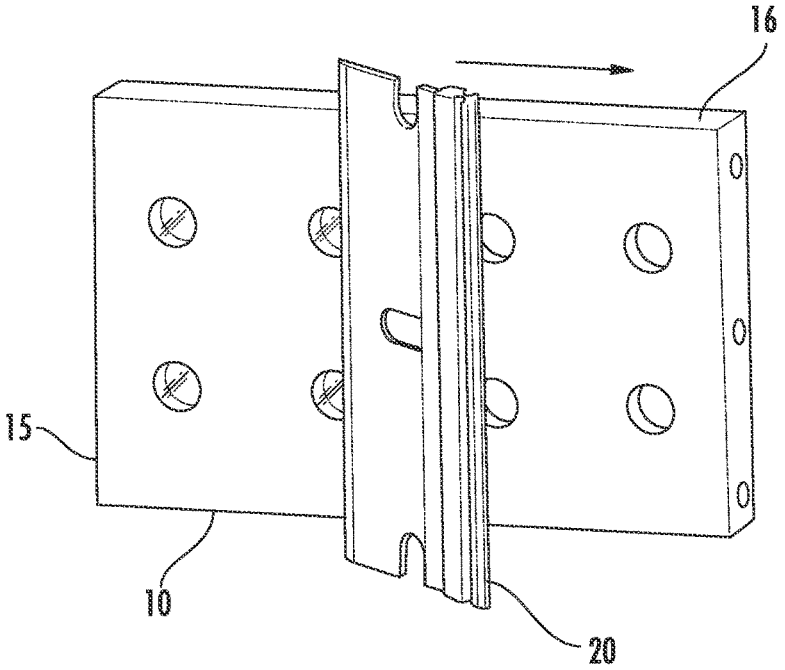
FIG. 4*a* illustrates a liquid crystal film formation apparatus consisting of a copper frame with approximately 4 millimeter diameter holes. A small volume of liquid crystal placed on the edge of a wiper can be drawn across these frame holes in a controlled fashion, leaving a liquid crystal film in its wake.
Figure 4B:
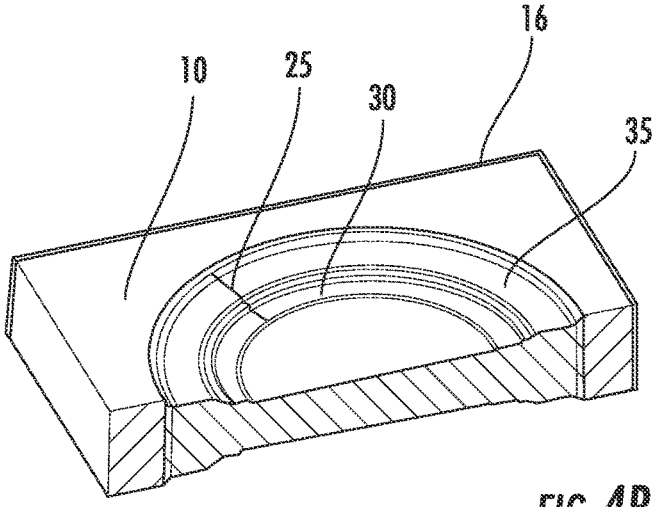
FIG. 4*b* depicts an inner thin region surrounded by a thicker meniscus that attaches film to frame. The transition between these two thicknesses is not continuous, but rather occurs in a step-like fashion.

FIG. 4*a* illustrates an embodiment of a film generation apparatus. Freely suspended films 15 can be formed by drawing a precise volume of LC across a hole 16 in a rigid frame 10. A wiper 20 can be used for drawing. As shown in FIG. 4*a*, the wiper can comprise a razor blade, although any material that does not absorb the LC will suffice. This formation method results in a film as depicted in FIG. 4*b* with a thin inner region 30 that widens near the frame edge 16 into a thick meniscus 35. The transition between this thin region and the meniscus is not continuous, but rather comprises a series of steps 25 corresponding to some multiple of the smectic layer height. It is not uncommon for the inner region to consist of tens of layers and the meniscus to have many hundreds, depending on the amount of LC used to make the film.

Figure 5A:
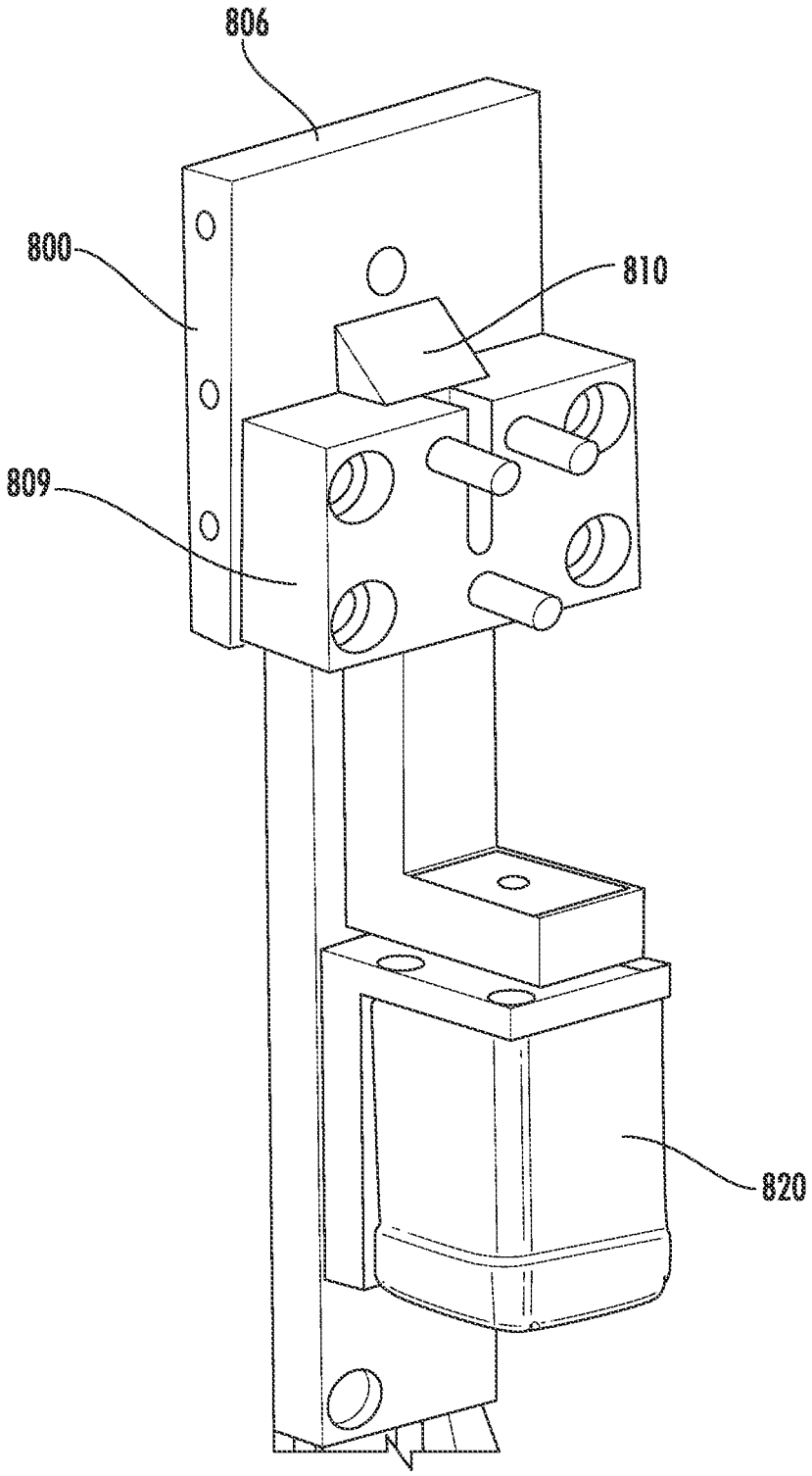
FIG. 5*a* is a rendering of an embodiment of a device for creating a thin-film liquid laser target with a linear rail.

FIG. 5*a* shows another aspect of the present disclosure comprising a vertically oriented rail 800. The wiper 810 is caused to slide across the rail and over at least one hole 806 by a motor or a solenoid 820 up to several times per second. The hole(s) 806 do not have to be circular. The hole(s) can be square, for example, or any other shape. The hole(s) can, furthermore, be arranged in any pattern on the rail 800. The wiper 810 can be held in contact with the rail 800 with a bracket 809. The rail 800 can be heated (not shown) using, for example, a cartridge heater and/or induction heater. Temperature control can be achieved using one or more thermocouples and a PID controller. Alternatively, cartridge heaters (not shown) for temperature control using a PID controller can be used to heat the LC film. Moreover, volume control can be achieved by metering using a precision syringe pump (not shown). In one embodiment, the device can furthermore have an additional linear stage (not shown) for fine position adjustment with, for example, a picomotor piezo linear actuator, to change the relative position of the wiper and the rail on a small (e.g. approximately tens of nanometer) scale.

Figure 5B:
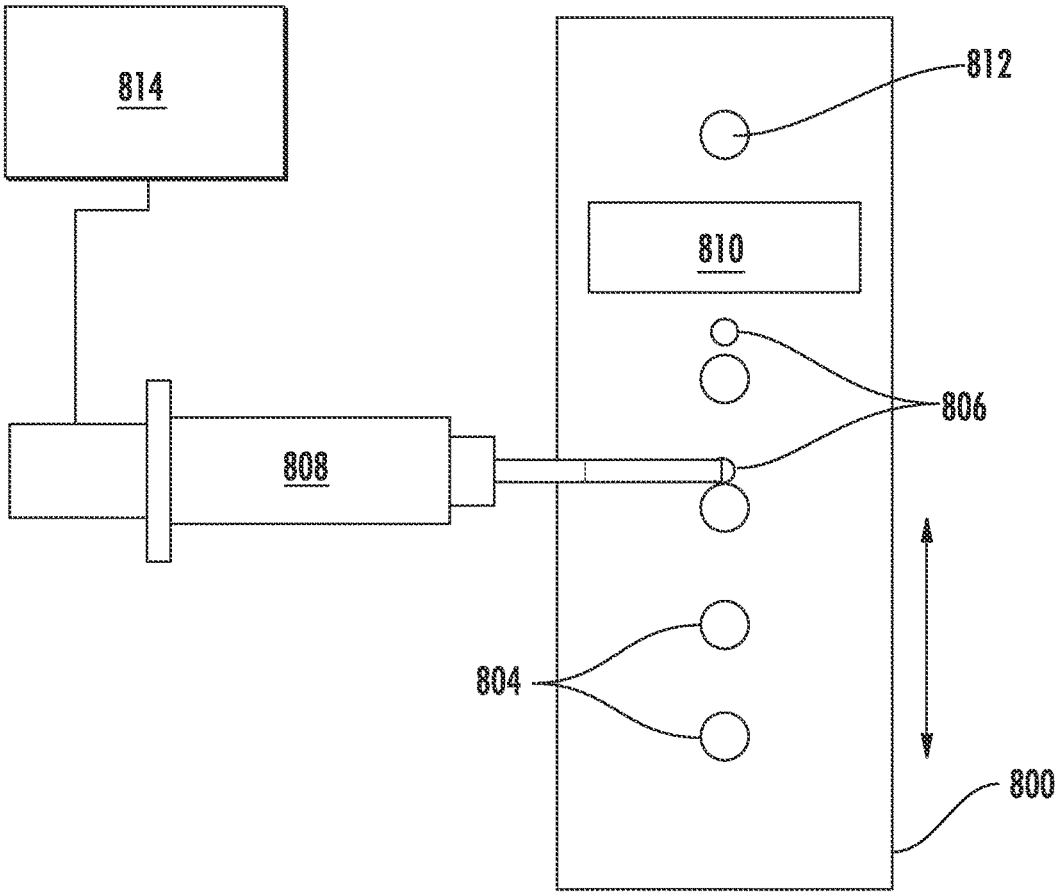
FIG. 5*b* illustrates an alternate embodiment of a device for creating a thin-film liquid laser target with a linear rail.

FIG. 5*b* illustrates a schematic or an embodiment of a device for creating a thin-film liquid laser target using a vertically oriented linear rail 800. In this embodiment, the rail 800 comprising one or more holes 804 can move back and forth in a linear direction. As the rail 800 moves, a precision measured drop 806 of liquid target material is placed on the rail 800 near one of the one or more holes 804 or within the hole 804. In this embodiment, the drop 806 is placed using a precision pump 808 such as, for example, a syringe pump. The syringe pump can comprise a Harvard Apparatus PHD syringe pump. As the rail 800 continues to move, the drop 806 encounters a wiper 810 that spreads the drop 806 across the hole 802, creating a thin film laser target 812 in the hole 802. As shown in FIG. 5*b*, the pump 808 can be controlled by a control device 814. The control device 814 can be, for example, a microprocessor, a programmable logic controller (PLC), a field-programmable gate array (FPGA), a laptop computer, and the like. This configuration can lead to high repetition rates, for example, accommodating firing rates up to several Hz. The thickness of the film 812 in the one or more holes 804 can be controlled by the speed of movement of the rail, wiper angle with respect to the rail, thickness of the small holes, volume of the drop of liquid target material, properties of the liquid and temperature control of the rail and/or the liquid. It is also to be appreciated that in another embodiment the rail 800 can remain stationary while the wiper 810 is caused to move over one or more of the holes 804.

In one aspect of the disclosure, films can be made in individual frames comprised of, for example, copper, to the desired thickness via the mechanical wiping mechanism described above. These films can then be transferred to a vacuum chamber which can be subsequently pumped down and maintained at the $10^{-6}$ Torr level before final target alignment. High repetition rate shots may necessitate in-vacuum film formation. To this end, the film formation device can be designed such that they are installed on a target positioner jig at a target chamber center. Because accurate temperature control can affect thickness manipulation, both the frame and wiper of the device can be primarily made of heat-conductive material such as copper. The frame can have, as an example, an approximately 4 mm diameter clearance hole to act as an aperture for film formation. In various embodiments, one side of this aperture can have an approximately 45 degree bevel to allow attenuated, unamplified short pulse light to be collected and characterized on an in-situ camera just behind chamber center. This aperture bevel may have the added benefit of moving a forming film to its edge, providing repeatable film positioning.

Figure 6B:
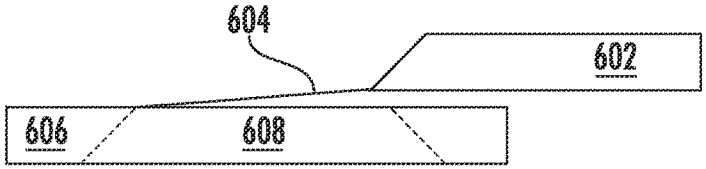
FIGS. 6*a*-6*c* show the geometry of a beveled aperture and raised wiper provide a consistent film formation plane.
Figure 6A:
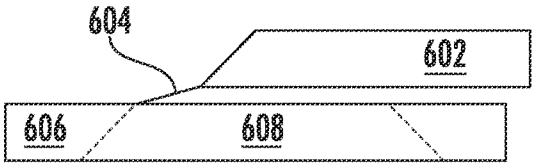
Figure 6C:
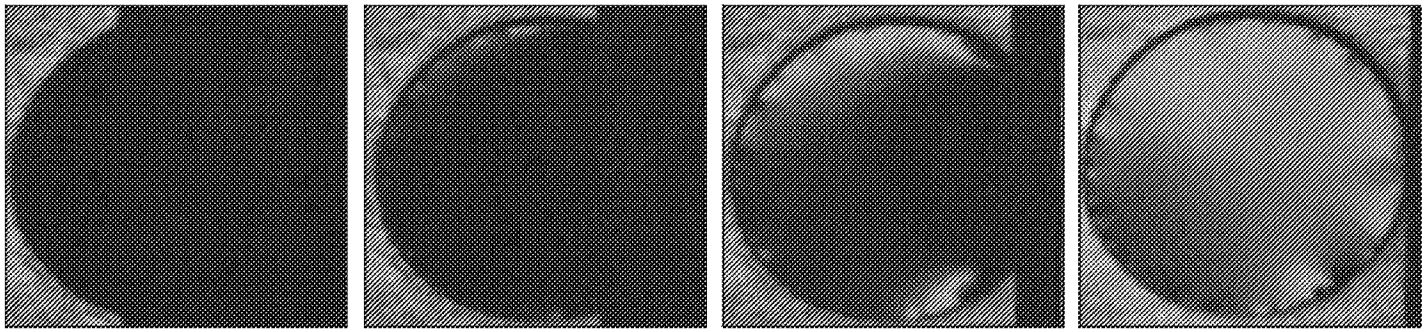

The wiper can have a beveled top edge that can be pushed vertically with a full travel of approximately 50 mm by a vacuum motor, for example, a NEMA 8 vacuum motor (Hayden Kirk). In one aspect, the wiper can be at least partially comprised of copper. FIG. 6*a*-6*c* shows the geometry of the beveled aperture and raised wiper provide a consistent film formation plane. In FIG. 6*a*, it is shown that a film can initially form between the aperture and the wiper, such that it is being pulled at an angle with respect to the aperture plane. In FIG. 6*b*, it is shown that as the wiper continues drawing, more of the film can be transferred to front edge of the beveled aperture. FIG. 6*c* illustrate an exemplary film during formation. As the wiper moves from left to right, the forming film can be brought closer to parallel with the frame aperture, and can result in the correct angle for observing a pink color stemming from constructive interference at this film thickness of 530 nm.

Furthermore, in one embodiment the wiper can be held flush to the frame by a polyether ether ketone (PEEK) bridge. This piece can have, for example, three Delrin-tipped spring-loaded plungers to provide a variable amount of force pressing the wiper down onto the frame, as a firm connection may be necessary for film formation.

The volume of liquid crystal present in a single film of sub-μm thickness is on may be on the order of approximately 10 nL. An approximately 2 mm diameter clearance hole can be placed in the wiper for the application of liquid crystal directly to the space between the wiper and frame. This can be done for example, with tubing connected from this clearance hole to a precision syringe pump (e.g., Harvard Apparatus) for fine control of volume deposition. It may be preferable to simply apply a volume on the order of approximately 1 μL, more than that required for one film for example, and to vary other film formation parameters to control thickness. In this way one application of liquid crystal volume before chamber evacuation can provide, for example, hundreds of films before more volume is needed, in this case bypassing the need for the syringe pump and small inner diameter tubing on the vacuum chamber.

A large initial volume deposition of LC may have the additional benefit of preventing scratching between the two copper surfaces of wiper and frame. With insufficient lubrication these grooves can grow over several draws into channels that change the liquid crystal volume present near the film aperture that can hinder full thickness control. To minimize these surface effects both the wiper and frame pieces can be polished with successively fine grains of sandpaper from approximately 160 to 2000 grit, followed by a polish or wax to a mirror finish. Maintaining this level of surface smoothness can increase the thickness repeatability.

An additional measure that can be taken to reduce frame scratching can be to modify the wiper to include a Teflon™ piece affixed to the bottom of the wiper. With this wiper design scratches may only form on the Teflon wiper, and only over a large number of film draws. While the Teflon cover may ensure greater film thickness control through scratch prevention for many more draws than the pure copper wiper, the reduced adhesion of liquid crystal to the Teflon surface can result in slightly different film formation behavior.

Figure 7B:
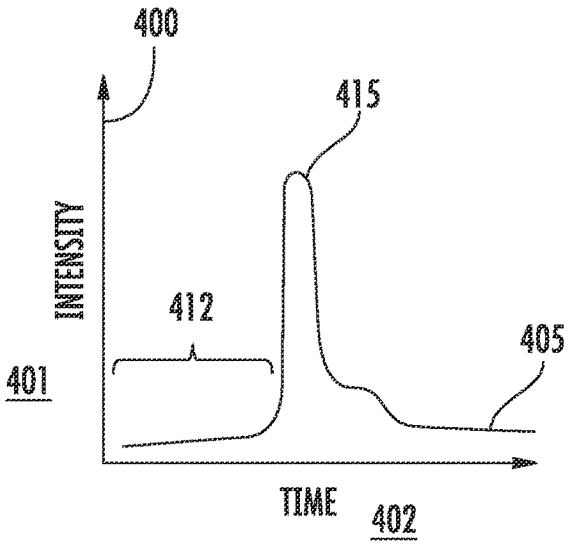
FIGS. 7*a* and 7*b* show a schematic plot of an intense laser pulse's intensity versus time before (7*a*) and after (7*b*) interaction with a liquid crystal target.
Figure 7A:
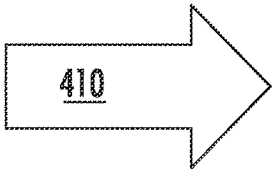
Figure 7A:
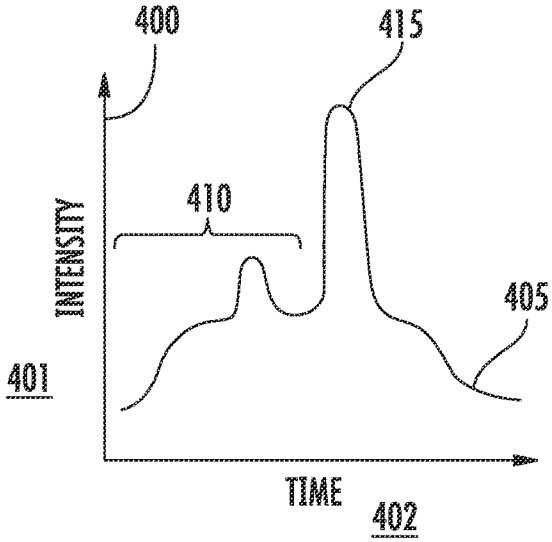

FIG. 7 shows a plot 400 of an intense laser pulse's 405 intensity 401 versus time 402. Here the weak pulses referred to as the pre-pulse 410 precedes the main, more powerful pulse 415. Here, the apparatuses described in relation to FIGS. 1-5 (and also the apparatus shown in FIGS. 11*a*-11*c*, description provided later) can be used to generate LC's that can be used to clean the intense laser pulse 405 by removing pre-pulse 412 and sharpening the leading edge of the main pulse 415. Real-time LC film thickness tuning allows for controlling the degree of cleaning. The LCs can absorb or reflect the pre-pulse and allow the main pulse to transmit through with little modification. In one embodiment, the LC film can be destroyed by each pre-pulse, but another LC film is generated before the next pulse arrives, leading to high repetition rates.

Different film thicknesses for LC targets can be generated with the apparatuses in FIGS. 1-5 (and also the apparatus shown in FIGS. 11*a*-11*c*, description provided later) and can be measured with a multi-spectral interferometer. Thin film interferometry can be used to measure thickness of the films. This is because the thickness of the smectic LCs tends to be on the order of optical wavelengths and furthermore, the films are transparent in their freely suspended smectic state. This is the mechanism utilized in, for example, a Filmetrics F20 multi-spectral thin film measurement device. This device measures the reflected spectrum using a known input spectrum from 400 to 1000 nanometers (using a halogen lamp source) and the reflected spectrum from a reference material to determine thickness in real-time. Additionally it has a 2 nanometer measurement accuracy, a 50 millisecond acquisition time, and a standoff distance of a few inches that can be increased to over 48 inches with imaging. Other film characterization methods can be used.

The devices shown in FIGS. 1-5 and FIGS. 11*a*-11*c* can further be temperature controlled during LC film formation. For example, any of the devices of FIGS. 1-5 can comprise a copper frame or disk heated by a cartridge heater (e.g., an approximately 25 W cartridge heater) operated at low current. The temperature is maintained roughly a few degrees below the smectic/nematic phase transition of the liquid target material. For example, for 8CB, these temperatures can be approximately 27.5 to 28.5° C. A PID controller and thermocouple can be used for fine temperature control, in order to maintain temperature within approximately 0.1° C. This temperature control can be achieved by heating the disk 50 from FIGS. 1, 60 from FIG. 2, 302 from FIGS. 3*a* and 3*b*, the frame 10 from FIG. 4, and the linear rail 800 of FIG. 5, and the separate piece of the chariot 935 and rail 940 target inserter of FIGS. 11*a*-11*c*. In this regard, a variety of metals (for example copper) or other thermally conductive materials can be used to comprise the frame, rail or disk. Alternatively, the temperature can be achieved using an induction heater. This can comprise heating the disk 50 from FIG. 1, disk 60 from FIG. 2, disk 302 from FIGS. 3*a* and 3*b*, the frame 10 from FIG. 4, the linear rail 800 of FIG. 5, the separate piece of the chariot 935 and rail 940 target inserter of FIGS. 11*a*-11*c*, and/or the LC film by electromagnetic induction, where eddy currents are generated within the frame, rail or disk and/or the LC film for Joule heating of the frame, rail or disk and/or the LC film. The induction heater may comprise an electromagnet, through which a high-frequency alternating current (AC) is passed. Heat may also be generated by magnetic hysteresis losses in the disk 50 from FIG. 1, 60 from FIG. 2, 302 from FIGS. 3*a* and 3*b*, the frame 10 from FIG. 4, the linear rail 800 of FIG. 5, and the separate piece of the chariot 935 and rail 940 target inserter of FIGS. 11*a*-11*c*, if the materials composing them have significant relative permeability. The frequency of AC used depends on the frame, rail or disk size, material type, coupling (between the work coil and the frame, rail or disk and/or LC film) and the penetration depth. Finally, a cartridge heater can be used to heat the disk 50 from FIGS. 1, 60 from FIG. 2, 302 from FIGS. 3*a* and 3*b*, the frame 10 from FIG. 4, the linear rail 800 of FIG. 5, and the separate piece of the chariot 935 and rail 940 target inserter of FIG. 11, and/or the LC film. The cartridge heater can comprise, for example, a tube-shaped, heavy-duty, industrial Joule heating element, which can be custom manufactured to a specific Watt density. Optical pyrometry, where a non-contacting optical device intercepts and measures thermal radiation, can be further used to measure the temperature of the film ex situ.

As film thickness control can require temperature modulation and monitoring, it may be useful to be able to cool components of the laser target formation devices. For example, in a vacuum environment, heat can eventually accumulate from the motor that drives the film wiper and spread up to the film area, resulting in a temperature gradient that produces uneven films and in general can impede thickness control. To accommodate this, holes (for example, two approximately 3 mm diameter clearance holes) can be bored at different heights horizontally through the wiper to be used for the insertion of a copper tubing line connected through the vacuum chamber wall to a small water chilling unit. A third channel can allow a thermocouple such as, for example, a Type K thermocouple, to be inserted internal to the frame near the film formation aperture. In this way the frame temperature can be maintained to within approximately 0.1° C. of the desired temperature regardless of the variable thermal load from the motor.

Figure 8:
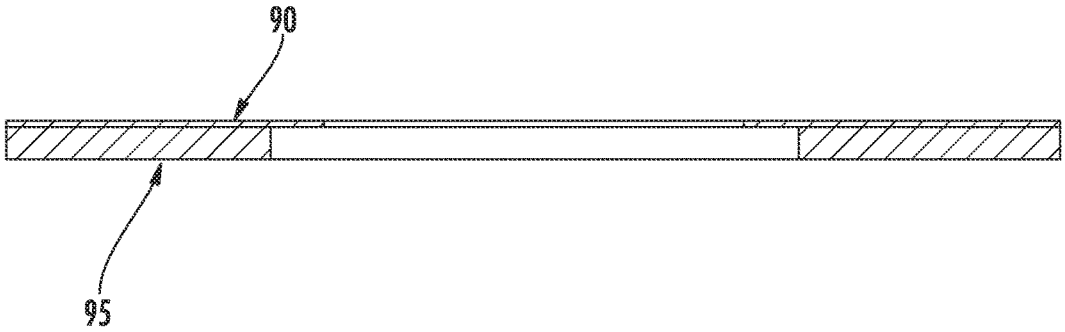
FIG. 8 shows an exemplary edge frame that can be used for controlling the depth of a liquid crystal film in the frame or disk holder.

Controlling the depth of the LC film in the frame 10 of FIG. 4*a* (and also, the disk 50 of FIG. 1, disk 62 of FIG. 2, and disk 302 of FIGS. 3*a* and 3*b*, the rail 800 of FIG. 5*b*, and the separate piece of the chariot 935 and rail 940 target inserter of FIGS. 11*a*-11*c*) is also desired where the film actually forms in the frame or disk. One possible solution is with an additional material, such as a diamond edge frame, in a layer 90, as shown is FIG. 8, that fits within or proximate to the holes or apertures in the frame or disk. This allows for the preferential adhesion of the film towards the layer 90, thus stabilizing the LC film's depth in the frame or disk. LC films may require application with added care to prevent the layer 90 from breaking; for example, by using a soft, cloth-like wiper such as lens tissue. A diamond layer can be formed for example, on commercial 10 μm thickness diamond on silicon substrates 95. Materials other than diamond of sufficient hardness and wettability by the LC material can be alternatively used as the layer 90.

As previously described, film thickness can be monitored via multi-spectral interferometer, for example, a spectral reflectance measurement from a Filmetrics F-20 device. Here white light of a known spectrum (for example, from a halogen lamp) can be reflected from the target film back towards the device; modulations in the reflected spectrum can form interference in the thin film. This, in combination with some knowledge of the liquid crystal index of refraction can be used to iteratively solve for the thickness. This process can have an approximately 50 ms integration time so it can be done at high repetition rates, and can have an accuracy of approximately 2 nm with proper calibration. The white light can be image-relayed from outside the vacuum chamber through a viewport using, for example, two achromatic lenses to provide minimal beam aberration, which can ensure thickness measurement accuracy. This light can be set up to hit the target at normal incidence so that the reflected spectrum can return to the device for analysis, and can have an automatic shutter to protect the input fiber during a laser shot.

Of note is the repeatability of the film formation plane of the vertically oriented rail device. A digital linear micrometer can be used in conjunction with, for example, the Scarlet laser (Ohio State University, 400 TW Titanium:sapphire-based short-pulse laser) which has a sub-Rayleigh range confocal positioning target alignment device to determine the film location upon destruction and subsequent reformation. A film can be placed at the best focus of the confocal positioner, then a new film can be drawn and the target frame can be moved until it was measured to again be at best focus of the alignment device. The digital micrometer can record the net displacement in the target plane during this so-called Z realignment. The root-mean-square (RMS) value of film position can be within approximately 2 μm, well within the approximately 5 μm Rayleigh range of the Scarlet laser.

Referring again to FIGS. 6*a*-6*c*, this repeated film formation position can be attributed to the beveled aperture placed in the copper frame. As the wiper 602 is drawn down, a film 604 can initially form with its upper edge connected to the copper frame 606 and its lower edge still connected to the wiper, which can be some small amount (e.g. sub-mm) above the plane of the copper frame 606 due to the effect of polishing the wiper edge. Because of this the film 604 can begin at an angle with respect to the copper frame (and its eventual resting plane). The surface tension of the liquid crystal can be such that the wiper 602 pulls the film up towards the wiper 602 as it moves downward, effectively shifting the liquid crystal film 604 to be on the extreme front edge of the frame 606 as it is being formed. As the wiper 602 moves down this angle between the film 604 and the copper frame 606 plane decreases, and as the wiper edge leaves the aperture area the film can snap down into place, now fully contained within the copper frame aperture 608 (schematic snapshots of these steps are represented in FIG. 6*c*). In this way films can be brought to the same plane within approximately 2 μm of the previous film location each time. To test this, films many microns thick (e.g. approximately greater than 2 μm) can be formed using the slowest motors speeds. The results of the test indicated, that the location of the front surface of such film was a distance from the previous film position by a value equal to their measured thickness, consistently. This indicated that the back surface of each film can form in a stationary spot within the frame aperture.

As previously described, film thickness can be affected by, among other things, the wiper angle, wiper draw speed, and frame hole size. Additionally, the volume and temperature of the LC as the film is being drawn affect the film thickness. Volumes as small as 100 nL are sufficient to produce a film. Without temperature control, larger initial volume results in a thicker meniscus (35 of FIG. 4*b*) with no increase in the thickness of the inner region (30 of FIG. 4*b*), which is typically a few hundred nanometers thick. At room temperature a drawn film can have a transparent inner region and an opaque white meniscus that resembles bulk LC. If the frame is heated to the appropriate temperature after a film has been drawn, the meniscus region that began opaque can become transparent and move inward to cover the inner thin layer over a period of seconds. This often results in a film with thickness that varies in a step-like fashion radially increasing from the center. Films drawn with LC and frame or disk pre-heated to approximately 28.0±0.5° C. may form with no meniscus and instead have a thick inner area. Additionally, horizontal frame orientation is optimal to prevent the heated LC from draining due to gravity, which results in a thicker film at the bottom of the frame. This draining effect can be minimized if the frame is allowed to cool to room temperature in its horizontal orientation, and is entirely eliminated if the film is also formed with no meniscus.

Although temperature, applied volume, and surface polish all can have some effect, for practical film repeatability wiper speed is the quickest and most convenient method for tuning film thickness. For example, while the volume applied demonstrably governs the upper limit to thickness produced at any speed, sub-100 nm films can still be produced when the applied volume is greater than approximately 10 μL. Furthermore, while in general a higher temperature results in a thicker films (for example, even at temperatures of approximately 29.5° C., which is near the smectic/nematic phase transition of 8CB), a fast wiper speed can still generate a thin film.

Figure 9:
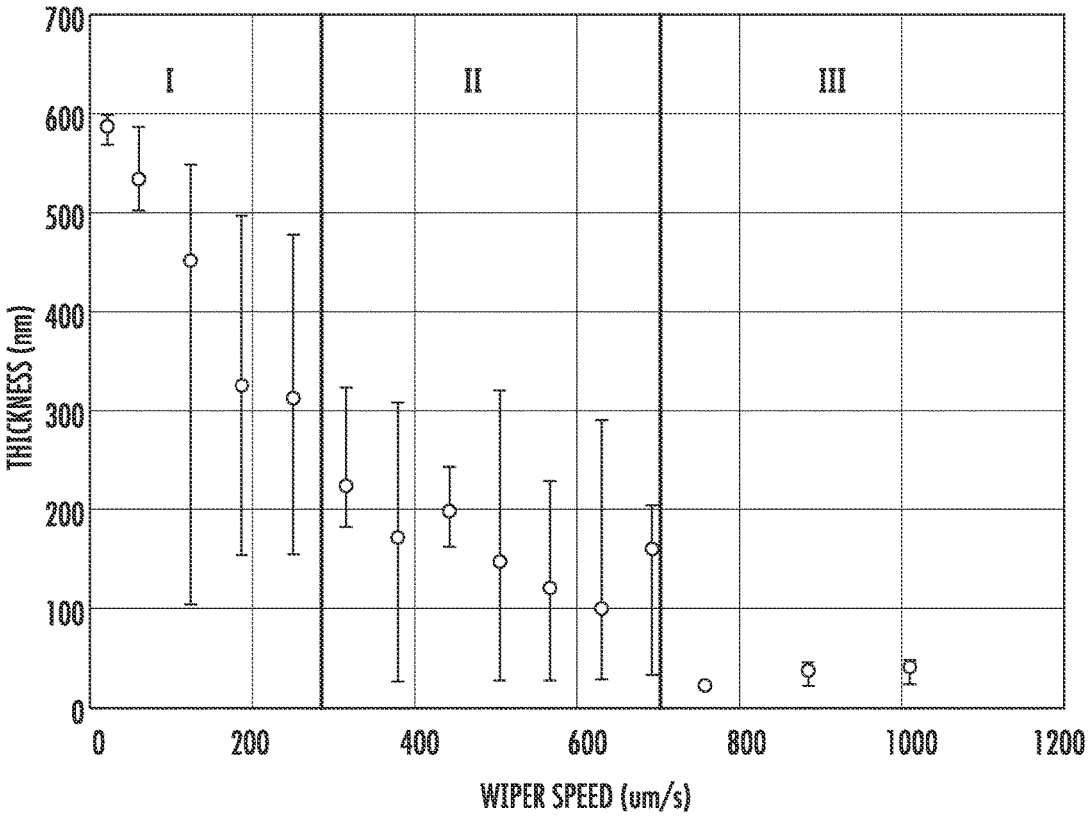
FIG. 9 shows a graph of the control of film thickness versus wiper speed for a linear rail liquid film creation device.

The effect of wiper speed can be seen in FIG. 9, where three regions of film formation have been highlighted. The figure shows a graph of the control of film thickness vs. the linear rail's wiper speed. The figure shows that on average thickness increases as the wiper speed decreases. The figure indicates three different regions of thickness range.

Region III, at the fastest wiper speeds, can produce an approximately sub-100 nm film with precision within approximately 10 nm each time. The thickness formed in this region can only be a weak function of the applied volume and temperature. Film formation at these wiper speeds can provide high repetition rate films applications where a consistent and thin target is desired. The relatively large surface tension inherent to the smectic liquid crystal phase (on the order of approximately 50 dynes/cm) can allow film formation even at high wiper speeds. As a result the maximum draw time can be limited currently by the choice of motor, not the liquid crystal itself. With top motor speeds a thin film can be formed at a repetition rate of approximately 0.3 Hz.

Regions I and II both have less precision at a given wiper speed. The vertical bars in FIG. 9 indicate the range of film thicknesses produced at the given wiper speed, while the dot shows the average over these thicknesses. Region II can occur in the few hundred μm/s wiper speed range, varying slightly with applied volume and temperature. Here films thicknesses can be typically between approximately 100 and 500 nm, changing as a slightly stronger function of volume than in Region III. Region II can have a larger potential film thickness range at a given wiper speed than Region III, but in general this average thickness can now increase as the wiper speed decreases. Region I is typically below approximately 100 μm/s wiper speed and results in film thicknesses up to approximately several μm, where this maximum possible thickness can be correlated directly to the volume of liquid crystal applied.

Volume control can be a strong tool for film thickness control when forming single-shot films manually, but a large volume of liquid crystal may be applied between the wiper and frame for reasons discussed above. An approximate method of volume control can be to change how far above the film aperture the wiper moves (see, for example, FIGS. 6*a*-6*c*), which can determine how much liquid crystal volume clinging to the wiper can be brought to the film aperture before drawing. For example, beginning a draw from approximately 1.5 mm above the aperture can result in a thicker film than if the initial draw is from approximately 0.5 mm above the aperture, simply because of the extra volume brought into the frame aperture region. In this way, the thicker range at a given wiper speed in FIG. 9 can be preferentially accessed by beginning a draw from higher up on the frame.

If a film formed is instead thicker than desired, a similar technique can generate a subsequently thinner one. The process can be to move the wiper again over the aperture area at a slightly faster speed, effectively wiping away some of the smectic layers of the film.

Though films formed in Regions I and II do not have the precision of those from Region III, the thickening and thinning techniques outlined above can allow the desired film thickness to be approached over only a few wipes. By selecting the appropriate wiper speed, the desired thickness can be reached within approximately 10 percent in only a few draws, with increased precision possible as the film is re-drawn. Since each draw can take a matter of seconds, multiple re-draws are easily feasible for most current high power laser systems. For example, the linear rail and its associated thin film formation techniques can enable the approximately 400 W Scarlet laser to achieve shots at its full repetition rate of 1/min. Additionally, the stability of the smectic liquid crystal phase combined with its low vapor pressure can enable films formed within the linear rail to maintain their thickness nearly indefinitely, making them useful for laser systems with repetition rates of once approximately every few minutes to hours.

LC films can exhibit other thickness variations other than the meniscus/thin inner region morphology. It is not uncommon in freely suspended liquid crystal films for small volumes to move away from the meniscus (35 of FIG. 4*b*) to float on top of the thin inner layers (30 of FIG. 4*b*); the formation and manipulation of these "islands" are the subject of study within LC fluid dynamics. They can be mobile and can respond to air currents and gravity. Though they usually return eventually to the meniscus region, islands can be many layers thick and as much as a few millimeters across while moving over the film. Islands represent a difficulty for LC films as laser-matter experiment targets in that they constitute a large, mobile thickness variation. Additionally, the meniscus of a film drawn horizontally but then turned vertically can drain downward due to gravity over the course of minutes. While this process will not destroy the film, the target will eventually be a few hundred nanometers thick at its top and a few microns thick at the bottom. To address both of these challenges and achieve a consistent thickness the meniscus region can be reduced or eliminated. This can be done with careful temperature control within the previously mentioned range and by using a minimal volume of LC for each film, allowing film thicknesses between 10 and 5000 nanometers or more.

Figure 10:
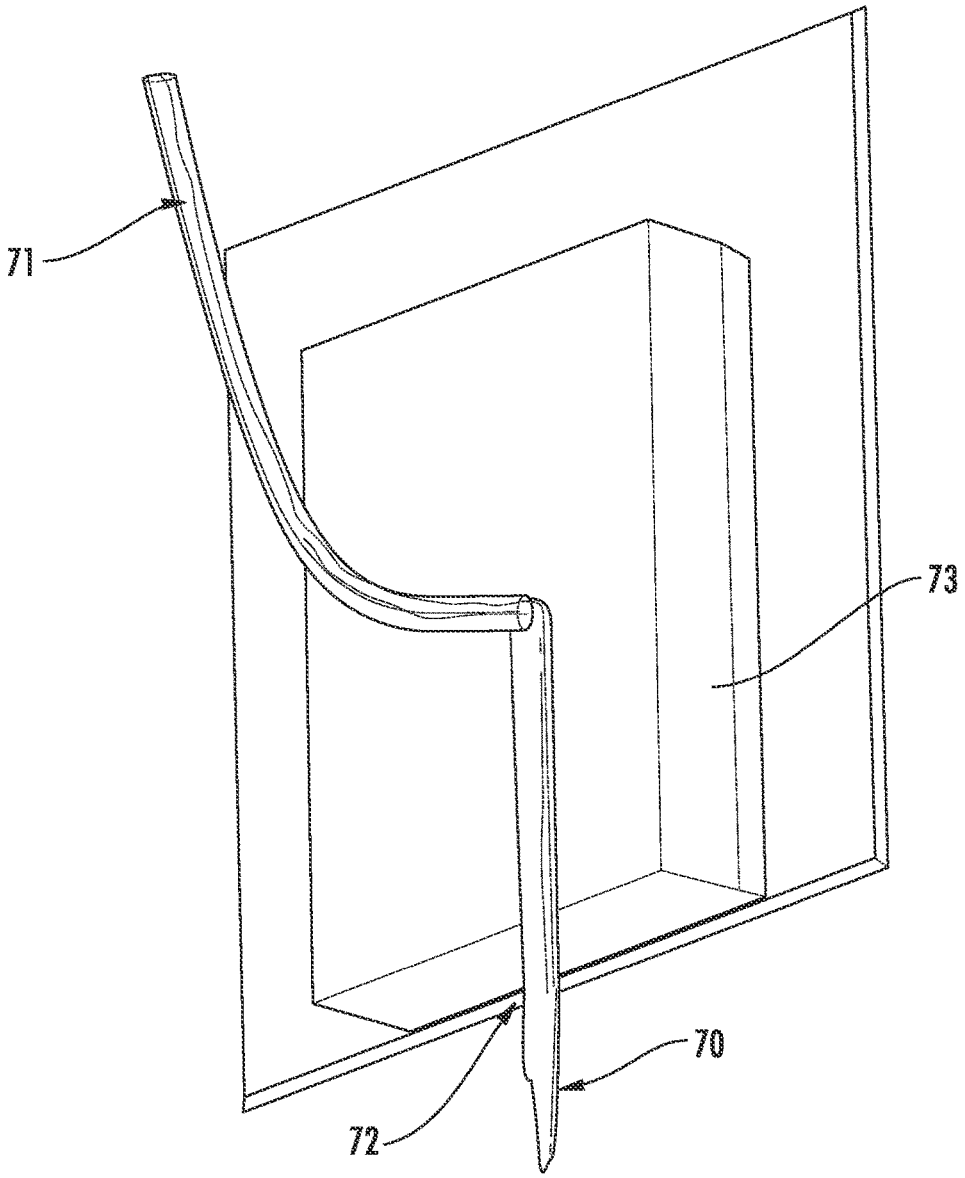
FIG. 10 shows another aspect of the disclosure wherein a jet of bulk liquid crystal material is created by directing a stream of the liquid at high pressures through a small rectangular nozzle.

FIG. 10 shows another aspect of the present disclosure wherein a jet of film target material (i.e., bulk LC) 70 is created by directing a stream of the liquid 71 at high pressures through a small nozzle 72. The nozzle can be rectangular, square, oval, or any other shape that forms a thin liquid film. In one embodiment, the nozzle dimension can be either automatically or manually adjusted. By varying the nozzle dimensions, as well as the LC properties and driving pressure, the thickness of the expelled jet can be varied from a few microns down to sub-micron levels. In this instance the laser may be aimed below the nozzle 72 such that it interacts with a stable thin sheet 70 of the LC. The excess LC can be collected in a reservoir and pumped through the jet plumbing again. The jet can comprise a substrate 73, for example, PDMS on a Si substrate. For added control of the LC jet, substrates comprising fused silica, sapphire or similar materials can be used. The nozzle or the substrate can additionally be heated to further control the jet. The heating can be done with, for example, a heater cartridge or an induction heater, and the like. The apparatus can be used in a moderate vacuum (<approximately 0.0001 Torr) environment. Filters (not shown) can be placed before the jet nozzle to eliminate contamination that might clog the jet.

Figure 11A:
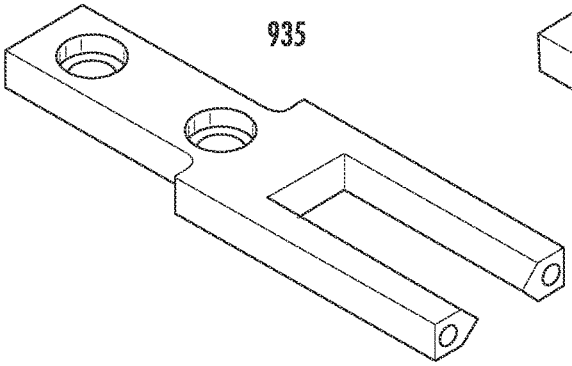
FIGS. 11*a*-11*c* show another aspect of the disclosure wherein liquid crystal material placed at connecting edge between two interlocking parts forms a liquid thin-film target as the two interlocking parts are move away from one another (shown in FIG. 11*c*).
Figure 11B:
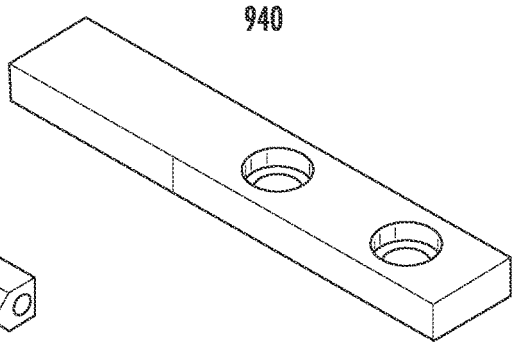
Figure 11C:
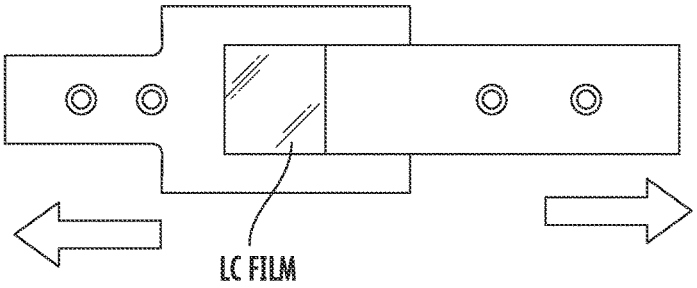

FIGS. 11*a*-11*c* show another aspect of the present disclosure wherein the LC can be placed at the connecting edge between two interlocking pieces, for example, made from copper. Generally, this embodiment comprises two interlocking pieces that can be referred to as a chariot 935 (FIG. 11*a*) and a rail 940 (FIG. 11*b*). As shown in FIG. 11*c*, when one piece (e.g. either the chariot 935 or the rail 940) is moved away from the other, a film 945 can be stretched in between the two interlocking pieces. The temperature, the speed of separating the two pieces, and volume regulation are some available parameters for controlling film formation, as described above in other contexts. The chariot 935 and rail 940 can be heated (not shown) using, for example, a cartridge heater and/or induction heater. Temperature control can be achieved using one or more thermocouples and a PID controller. Alternatively, cartridge heaters (not shown) for temperature control using a PID controller can be used to heat the LC film. Moreover, volume control can be achieved by metering using a precision syringe pump (not shown).

Figure 12:
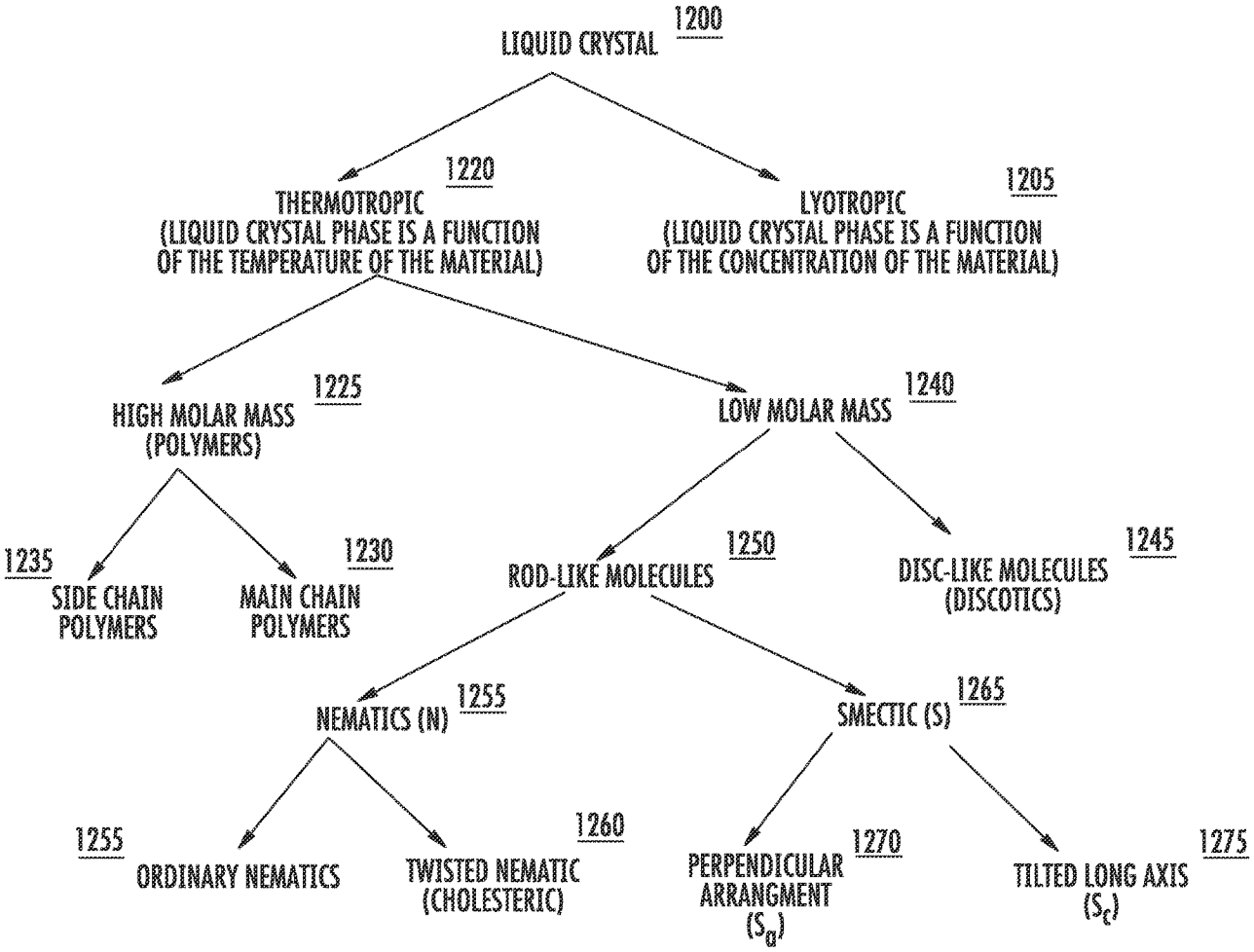
FIG. 12 shows a diagram of the classification of liquid crystals.

As described above, the liquid target material can comprise a LC material. As shown in FIG. 12, LCs 1200 can be first classified into thermotropic 1220 (where the phase is temperature dependent) and lyotropic 1205 (where the phase is concentration dependent) types. Within thermotropic 1220 LCs there are high molar mass 1225 materials (suitable for polymer) and low molar mass materials 1240. Within the high molar mass kind there are main chain polymers 1230 where the chains align in a direction, or side chin polymers 1235 where there is comb-like structure with side chains that hang off the polymer.

In the low molar mass materials 1240 there are disc like molecules 1245 (discotic LCs) and rod-like molecules 1250 (calamitic LCs). Within the calamitic 1250 LCs are nematic LCs 1255. Nematic LC molecules can be characterized as having one axis (called the long axis) in which the polarizability, and the dielectric constant and the index of refraction are different from the other two axes. The nematic LCs 1255 can further comprise a twisted nematic 1260 (cholesteric) subtype. In the cholesteric nematic LCs, a director—a dimensionless unit vector representing the direction of preferred orientation of molecules in the neighborhood of any point in the LC-changes across the material.

Furthermore, the calamitic 1250 LCs can comprise the smectic 1265 subtype. Smectic phases have more positional order perpendicular to the director. The smectic phase can further comprise the smectic A 1270 or smectic C 1275 subtypes. Smectic A 1270 is a phase in which the molecules are parallel to one another and are arranged in layers with the long axes perpendicular to the layer plane. Smectic C is a smectic A like structure in which the long axes of the molecules of a tilted average angle differing from 90° with respect to the plane of the layer in a "bookshelf" arrangement.

Calamitic LCs have a rigid polarizable core and have a flexible aliphatic tail on one of the sides. The cores make them want to line up and be more crystalline, while the flexible tail lowers the degree of order so they can flow. They may have polar groups such as the cyano group along the main axis, a fluorine group off the main axis, or a dipole moment due to nitrogen atoms in one of the rings along the axis.

A discotic phase is one in which flat molecules, typically with threefold or fourfold symmetry, that have a rigid core and several floppy side chains are stacked with their planes lying roughly parallel to one another. Thus, the director is oriented roughly perpendicular to the plane of the molecule. The discotics can stack up but have long tails (comprising, for instance, alkyl or alkoxy with C12 groups) that allow the discs to flow.

Water/oil based films may also be used, especially for diagnostic and prototyping purposes. Film can be used with the apparatuses and techniques described in this disclosure, that for example, comprise a solution of 93% water, 5% sodium dodecyl sulfate, and 2% glycerol. The laser used on these water/soap films had a 10 Hz repetition rate, a 60 mJ pulse energy, and a wavelength of 532 nanometers. Higher repetition rates can be achieved on thicker films (10's of micrometers). Surfactants with extremely low vapor pressures can be used to form a protective layer stabilizing the film. Soap and water forms a film easily in air, but not under vacuum. Non-water-based films are possible with silicone diffusion pump oils, e.g. Dow Corning 705. Furthermore, there may be additives to the various liquid crystal or oil/water films including, for example, metal elements.

Applications

Aspects of this disclosure can find application in diverse fields. For instance, when the target is used with an ultra-intense ultra-short laser pulse in a target normal sheath acceleration (TNSA) setup, highly energetic (multi-tens MeV) ion populations can be generated. These ions can then be used with an additional secondary target to generate neutrons. These neutrons can penetrate where optical or x-ray probes cannot (e.g. tens to hundreds of centimeters through steel). This provides useful imaging capability, for instance, in probing for defects on the interior of jet turbines without disassembling the turbine. It can also be used, for example, in the remote detection of fissile material. Currently large reactors are the current primary neutron sources-such reactors are scarce, expensive, and immobile.

Moreover, aspects of this disclosure may find application in national laboratories and universities (tens to hundreds of facilities around the world) using or studying laser-matter experimentation. Additionally, the disclosure may find application in radiation therapy in the medical field.

Additionally, the pulse cleaning aspect can find application in conjunction with the TNSA-related applications. For instance, the laser pulse can be cleaned with a LC film prior to its interaction with the target. It can also be used to clean laser pulses for any application where pre-pulse is undesirable. Such applications, such as laser ablation, may have no relation to high energy density physics experiments.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the scope of the methods and systems. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

4'-octyl-4-cyanobiphenyl, or 8CB, is a thermotropic LC, meaning its phase transitions occur due to temperature variations. 8CB transitions from its solid to the smectic phase around 294.5 K, from smectic to nematic at 306.5 K, and from nematic to isotropic (or conventional liquid) phase at 313.5 K. It is convenient for thin film formation because its smectic phase lies within normal room temperatures. 8CB has a density near that of water and a viscosity that varies with temperature but is thicker than ethylene glycol in its smectic phase.

To evaluate LC films for laser-matter experiments an initial ion acceleration experiment was performed using these targets. The experiment was done on the Scarlet laser facility at Ohio State University, which is a 400 TW Titanium:sapphire-based short-pulse laser system that delivers a maximum of 15 J of linearly-polarized 800 nanometer light in a 30 fs pulse to a 5 micrometer full-width at half-maximum focal spot (F/2.4) at a repetition rate of once per minute. Targets were prepared in air and then installed in an experimental vacuum chamber which was pumped down to a vacuum below $10^{-4}$ Torr. All laser shots occurred in vacuum. For these shots 4 J was delivered to the target at a 22.5° angle of incidence. The chief diagnostic was a Thomson parabola spectrometer located behind target normal to observe accelerated ions. A schematic of the experimental chamber setup is shown in FIGS. 13*a* and 13*b*. FIG. 13*a* presents a schematic of the Ohio State University Scarlet laser main experimental target chamber. An F/2.4 off-axis parabola (OAP) sends the 5 inch diameter beam toward the copper target frame shown in the left inset. An in-vacuum camera situated behind the target along the laser axis is used for alignment, while a Thomson parabola spectrometer collects ion data along the rear-target-normal direction. FIG. 13*b* is a representation of the actual experimental set-up with OAP in the background and the target frame and alignment objective in the foreground. FIG. 13*c* is a representation of a 3 μm Al film alignment fiducial within a LC film, as seen, for example, from another in-situ camera.

The 8CB was obtained from Alpha Micron. An initial volume between 100 and 1000 nL was delivered to the heated target frame using a Harvard Apparatus PHD Ultra syringe pump. The targets were aligned by floating a small 3 micrometer aluminum foil within the LC film itself, illuminating this edge with an alignment laser backlight, and imaging the shadow cast onto an in-vacuum camera setup located directly behind the target along the laser axis. A representation of a film and this alignment fiducial is shown in FIG. 13*c*. The camera can be imaged by an in-situ 10× infinity-corrected microscope objective with a 3.5 micrometer depth of focus over a 0.5 millimeter field of view. The camera and objective lens are situated on a vertical translation stage such that they can be moved safely away during a shot.

Figure 14A:
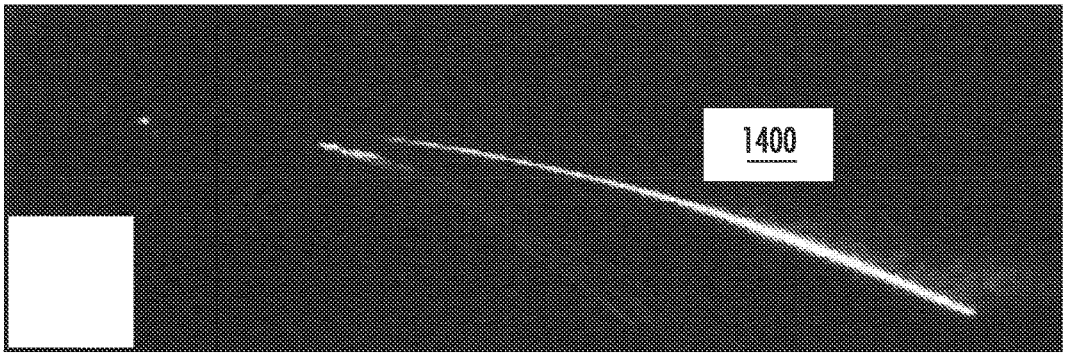
FIG. 14*a* shows ion acceleration data from the Thomson parabola spectrometer in the chamber from a 100 nanometer $Si_3N_4$ solid target.
Figure 14B:
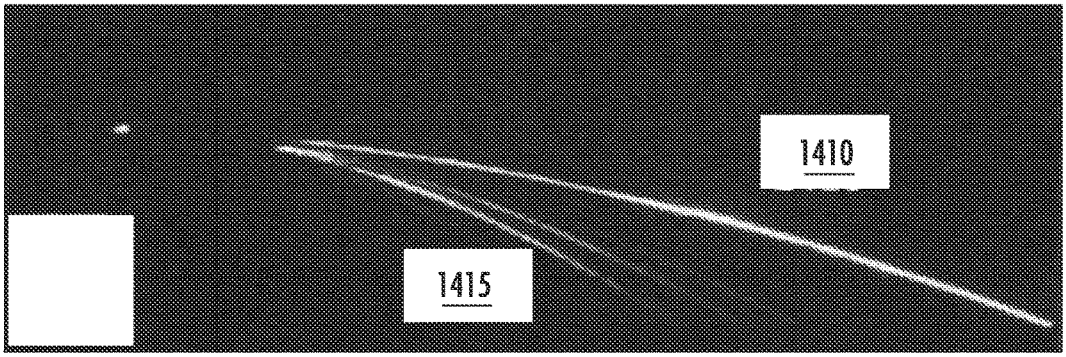
FIG. 14*b* shows ion acceleration data from the Thomson parabola spectrometer from a 700 nanometer thick liquid crystal film target.
Figure 14C:
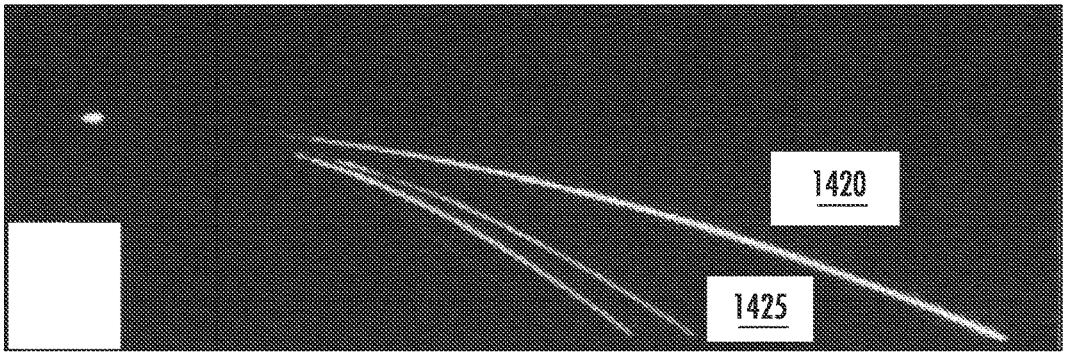
FIG. 14*c* shows ion acceleration data from the Thomson parabola spectrometer from a 160 nanometer liquid crystal film target of the present disclosure.

FIG. 14*a* shows ion acceleration data 1499 from the Thomson parabola spectrometer from a 100 nanometer $Si_3N_4$ solid target. FIG. 14*b* shows ion acceleration data from the Thomson parabola spectrometer from a 700 nanometer thick LC film target of the present disclosure. This ion trace shows a strong proton signal 1410 with maximum energy around 10 MeV, as well as multiple traces 1415 from other ion species, and is comparable to the trace from the solid target trace of FIG. 14*a*. FIG. 14*c* shows ion acceleration data from the Thomson parabola spectrometer from a 160 nanometer LC film target of the present disclosure. This ion trace also shows a strong proton signal 1420 with maximum energy around 10 MeV, as well as multiple traces 1425 from other ion species, and is comparable to the trace from the similar-thickness solid target trace of FIG. 14*a*.

Of note is the resiliency of liquid crystal films formed in the manner described here. A film drawn with little or no meniscus region can maintain its original thickness regardless of orientation, temperature, surrounding pressure, or gross motion of the frame. As a result the method for using these as intense laser targets is to make the film to the desired thickness using a heated frame, allow the frame to cool back to room temperature, mount the frame within the target chamber, then pump the chamber down to normal vacuum operating levels. Film thickness has been monitored carefully and observed not to fluctuate during these temperature or pressure changes. In fact, liquid crystal films brought down to $10^{-6}$ Torr and not shot were then re-measured once the target chamber had been vented back to atmospheric pressure, at which point their thickness was found to be identical to the original value at formation.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

Throughout this application, various publications may be referenced. The disclosures of these publications in their entireties are hereby incorporated by reference into this application in order to more fully describe the state of the art to which the methods and systems pertain.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A laser target comprised of:

a liquid film creation device, wherein said liquid film creation device is configured to form a liquid laser target comprised of a liquid crystal material.

2. The laser target of claim 1, wherein the liquid film creation device further comprises:

a disk, wherein said disk comprises one or more holes passing axially through the disk, wherein said disk spins about its axis forming the liquid laser target in at least one of the one or more holes.

3. The laser target of claim 2, further comprising a reservoir that contains a liquid that forms the liquid laser target, wherein a portion of the disk rotates through the liquid in the reservoir causing the liquid laser target to form in at least one of the one or more holes.

4. The laser target of claim 2, further comprising a pump, wherein a volume of a liquid that forms the liquid laser target is deposited near or in at least one of the holes that pass axially through the disk by the pump.

5. The laser target of claim 3, further comprising a wiper, wherein the wiper removes excess liquid from the disk and helps form the liquid laser target in at least one of the one or more holes.

6. The laser target of claim 1, wherein the liquid crystal material comprises 8CB (4'-octyl-4-cyanobiphenyl).

7. The laser target of claim 1, wherein the liquid crystal material comprises thermotropic liquid crystals or lyotropic liquid crystals.

8. The laser target of claim 1, wherein the liquid film creation device further comprises:

a linear rail, wherein said linear rail comprises one or more holes passing through a portion of the rail, wherein the liquid laser target is formed in at least one of the one or more holes.

9. The laser target of claim 1, wherein the liquid film creation device further comprises:

a block of material on a substrate, wherein the block further comprises a nozzle and wherein the liquid laser target is formed in at by forcing a liquid through the nozzle to form at least one stable thin sheet of the liquid.

10. A method of forming a laser target comprising:

providing a bulk liquid crystal material; and forming a thin-film liquid crystal laser target from the bulk liquid crystal material using a liquid film creation device, wherein the thin-film liquid crystal laser target is used as a target for a laser.

11. The method of claim 10, wherein forming the thin-film liquid crystal laser target comprises forming the thin-film liquid crystal laser target using a disk, wherein said disk comprises one or more holes passing axially through the disk, wherein said disk spins about its axis forming the thin-film liquid crystal laser target in at least one of the one or more holes.

12. The method of claim 10, wherein forming the thin-film liquid crystal laser target comprises forming the thin-film liquid crystal laser target using a linear rail, wherein said linear rail comprises one or more holes passing through a portion of the rail, wherein the thin-film liquid crystal laser target is formed in at least one of the one or more holes.

13. The method of claim 10, wherein forming the thin-film liquid crystal laser target comprises forming the thin-film liquid crystal laser target using a block of material on a substrate, wherein the block further comprises a nozzle and wherein the thin-film liquid crystal laser target is formed in at by forcing the bulk liquid crystal through the nozzle to form at least one stable thin sheet of the liquid.

14. The method of claim 10, wherein providing the bulk liquid crystal material comprises providing 8CB (4'-octyl-4-cyanobiphenyl).

15. The method of claim 10, wherein providing the bulk liquid crystal material comprises providing thermotropic liquid crystals or lyotropic liquid crystals.

16. The laser target of claim 1, wherein the liquid film creation device further comprises:

two pieces, wherein when at least a first of the two pieces is moved away from a second of the two pieces, a film can be stretched in between the two pieces forming the liquid laser target.

17. The laser target of claim 16, wherein the two pieces comprise two interlocking pieces.

18. The laser target of claim 17, wherein the two interlocking pieces comprise a chariot and a rail.

19. The method of claim 10, wherein forming the thin-film liquid crystal laser target comprises forming the thin-film liquid crystal laser target using two pieces, wherein when at least a first of the two pieces is moved away from a second of the two pieces, a film can be stretched in between the two pieces forming the thin-film liquid crystal laser target.

20. The laser target of claim 1, wherein the liquid laser target forms a plasma mirror.

21. The method of claim 10, wherein using the thin-film liquid crystal laser target as a target for a laser comprises using the thin-film liquid crystal laser target as a plasma mirror.

* * * * *